US010829871B2

(12) United States Patent
Burrage et al.

(10) Patent No.: US 10,829,871 B2
(45) Date of Patent: Nov. 10, 2020

(54) CONTINUOUS HEAT SET MACHINE AND SEALING HEAD FOR A CONTINUOUS HEAT SET MACHINE

(71) Applicant: Belmont Textile Machinery Company, Mt. Holly, NC (US)

(72) Inventors: Bernard M. Burrage, Chatsworth, GA (US); Marshall Stowe Rhyne, Gastonia, NC (US); Donald Alan Pubentz, Charlotte, NC (US); Jeffrey Todd Rhyne, Belmont, NC (US)

(73) Assignee: Belmont Textile Machinery Company, Mount Holly, NC (US)

( * ) Notice: Subject to any disclaimer, the term of this patent is extended or adjusted under 35 U.S.C. 154(b) by 0 days.

(21) Appl. No.: 16/264,917

(22) Filed: Feb. 1, 2019

(65) Prior Publication Data

US 2019/0292703 A1 Sep. 26, 2019

Related U.S. Application Data

(60) Provisional application No. 62/645,377, filed on Mar. 20, 2018.

(51) Int. Cl.

| | |
|---|---|
| ***D02J 13/00*** | (2006.01) |
| ***D06B 3/04*** | (2006.01) |
| ***D06B 23/18*** | (2006.01) |
| ***D06C 7/02*** | (2006.01) |

(52) U.S. Cl.

CPC ..... *D02J 13/001* (2013.01); *D06B 3/045* (2013.01); *D06B 23/18* (2013.01); *D06C 7/02* (2013.01)

(58) Field of Classification Search

CPC ..... D02J 13/001; D06C 7/00; D06C 7/02; D06B 3/045; D06B 23/18; D06B 2700/35; D06B 23/02; D06B 23/021; D06B 23/028; D06B 23/16; D02G 1/004; F16J 15/168; F16J 15/1618

See application file for complete search history.

(56) References Cited

U.S. PATENT DOCUMENTS

| | | | | | |
|---|---|---|---|---|---|
| 3,334,908 | A * | 8/1967 | Starbuck | D06B 23/18 | 277/345 |
| 3,511,065 | A * | 5/1970 | Hans | D06C 7/00 | 68/5 R |
| 4,214,758 | A * | 7/1980 | Gorodissky | D06B 23/18 | 277/387 |
| 4,434,633 | A * | 3/1984 | Winch | D06B 15/02 | 68/22 R |

(Continued)

FOREIGN PATENT DOCUMENTS

| | | | | |
|---|---|---|---|---|
| EP | 1762646 A2 * | 3/2007 | ..... | D06B 23/18 |
| WO | WO-2006040173 A1 * | 4/2006 | ..... | D06B 23/18 |

*Primary Examiner* — Amy Vanatta

(74) *Attorney, Agent, or Firm* — Shumaker, Loop & Kendrick, LLP

(57) ABSTRACT

A continuous process heat set tunnel for exerting a sealing force against a top sealing roll, a yarn-transporting conveyor and a bottom sealing roll. At least first and second top pneumatic lamella sealing cylinders are mounted on the sealing roll frame for exerting against the top lamella a sealing force against the roll surface of the top sealing roll, and at least first and second bottom pneumatic lamella sealing cylinders are mounted on the sealing roll frame for exerting against the bottom lamella a sealing force against the roll surface of the bottom sealing roll.

18 Claims, 14 Drawing Sheets

(56) References Cited

U.S. PATENT DOCUMENTS

| | | | | |
|---|---|---|---|---|
| 4,949,558 | A | 8/1990 | Enderlin | |
| 5,074,130 | A | 12/1991 | Enderlin | |
| 5,163,208 | A * | 11/1992 | Dittly | D06B 23/18 100/168 |
| 7,219,516 | B2 | 5/2007 | Rhyne et al. | |
| 7,543,463 | B2 | 6/2009 | Rhyne et al. | |
| 9,945,067 | B1 * | 4/2018 | Wolf | D06B 19/007 |
| 2007/0044428 | A1 * | 3/2007 | Mazoyer | D02J 13/006 53/137.2 |
| 2009/0253091 | A1 * | 10/2009 | Melgaard | D02J 13/001 432/123 |

* cited by examiner

CONTINUOUS HEAT SET MACHINE AND SEALING HEAD FOR A CONTINUOUS HEAT SET MACHINE

CROSS-REFERENCE TO RELATED APPLICATION

This U.S. Non-Provisional patent application claims priority from U.S. Provisional Patent Application No. 62/645,377 filed on Mar. 20, 2018, the contents of which are incorporated by reference herein in their entirety.

TECHNICAL FIELD AND BACKGROUND OF THE INVENTION

This invention relates to a machine for heat setting yarn, principally, but not exclusively, carpet yarn. The machine conditions twisted yarns with saturated steam to increase the crystallinity of the yarn and lock the twist or the crimp into the yarn. The machine is a continuous process machine with yarn entering one end of the machine, moving downstream through the machine and exiting the downstream end properly treated and ready for the next production step—typically winding onto yarn packages in preparation for carpet tufting.

In general, the heat setting machine includes a coiler or other yarn-depositing device for depositing yarn on a moving conveyor which carries the yarn into a pretreatment chamber where the yarn is heated. The yarn then passes through a sealing head that includes a set of entrance sealing rolls which maintain a pressurized environment within the system. The yarn is carried by the conveyor into an entrance-cooling chamber where cool, dry air is circulated through the yarn, cooling the yarn to a uniform temperature and thus allowing redevelopment of the bulk in the yarn. This cooling chamber also protects the sealing rolls from the higher temperature of the heating chamber.

The yarn then passes into a heating chamber where a homogeneous mixture of steam and air is circulated through the yarn. The yarn is carried by the conveyor out of the heating chamber into an exit cooling chamber where cool dry air is circulated through the yarn to reduce the yarn temperature, remove excess moisture, and protect the exit sealing rolls of an exit sealing head which cooperate with the entrance sealing rolls to maintain a pressurized environment within the system. The yarn passes through the exit sealing head and can be further dried, separated and wound onto packages on a take-up winder which runs in synchronization with the remaining components. The entrance and exit sealing heads are identical in construction and operation, and operate in synchrony to insure that the conveyor and the yarn move smoothly through the heat set machine from entrance to exit. A yarn accumulator can be part of the system, allowing the system to continue operating during winder doffing cycles.

Sealing heads are known in the art, and include such devices disclosed in U.S. Pat. Nos. 5,074,130, 4,949,558, 7,219,516 and 7,543,463. Each of these patents contains a general disclosure of paired rollers that transport yarn carried on a conveyor into and out of a continuous heat set machine. Several features are disclosed in this application that differentiate the machine and method from prior art machines and provide more efficient and safe operation. These features include use of pneumatic cylinders to effect sealing pressure on the sealing rolls, sealing lamellas that assemble more efficiently, retaining gibs that float in order to accommodate uniform radial movement of the sealing rolls, and a sealing head safety circuit that ensures access to reserve cylinder pressure in the event of a loss of air pressure by a principal air supply and/or electrical power supply. Additional improved features are explained below.

Continuous heat setting machines and continuous space dyeing lines were originally produced mainly for processing straight set yarns. Over time as carpet styling changed and the advent of solution dyed yarns for manufacturing carpets that do not require subsequent dyeing of the carpet yarn in the carpet form has made some carpet constructions less critical. Many factors have contributed to these changes over time, but there have been substantial improvements that enable carpet yarn to be made less expensively. The subsequent dyeing of non-dyed carpet yarns that have been heat set is much more critical from a quality standpoint and any inconsistencies related to the heat setting of the yarn that is subsequently dyed will show up as off-quality in the form of dye streaks as the dye take-up for these yarns will be different, therefore showing light and/or dark streaks in carpets.

Also, over time, the carpet industry has substituted different synthetic fiber types such as polypropylene, polyamide 6 (nylon), polyamide 6,6 (nylon 6,6) and polyester (PET) for example. All of these fiber types can be solution dyed.

At present many bulked continuous filament (BCF) carpets are produced from polyester. Polyester carpets can be manufactured from solution dyed yarns or dyed in the carpet form. Due to the inherent attributes of polyester, for example, stain resistance, polyester requires more energy to heat set the fiber so that the twist is properly set. For example, in a continuous autoclave, a typical heat setting temperatures for nylon 6 will average ~260 degrees F.; for nylon 6,6, ~270 degrees F.; and for polyester, ~280 degrees F. or higher. Polyester is inherently hydrophobic in comparison to nylon and of course, the heat transfer medium in a continuous autoclave is steam under pressure.

As styling over time has changed to more textured yarn for residential carpet, most of the high volume residential styles are manufactured with textured yarn. These carpets are often referred to as trackless carpets, being that the surface of the carpets is somewhat random in appearance after being sheared after the tufting process.

Many variations in the carpet products manufactured from textured yarns are more forgiving as far as heat setting, especially when using solution dyed yarns. Due to the increase in the use of textured yarns, the yarn depositing device is typically a stuffer box or texture box. In a typical example, on a 260 mm width conveyor belt, for a given denier 2 ply straight set yarn, an average belt density would be between ~300-325 grams/meter. For the same yarn that has been textured, the average belt density would be between ~275-300 grams/meter, and this belt density would not be evenly spaced apart across the width of the conveyor belt. Due to these facts, this innovative modular pneumatic sealing head with multiple air cylinders is designed to accommodate textured yarn mass bundles and adequately seal the continuous autoclave and reduce wear on the upper and lower sealing rolls and the associated wear items such as lamellas, reducing maintenance cost and associated process downtime required for rebuilding the sealing heads.

SUMMARY OF THE INVENTION

It is a principal object of the present invention to provide a modular, pneumatically operated sealing head that will allow for a yarn mass of bulked textured yarn with a higher pile height and an increased density located primarily in the center portion of a conveyor belt of a continuous autoclave to be properly processed as required. The inventions allow heat setting of these types of yarn products with reduced wear on lamellas and sealing rolls for increased productivity and more effective sealing at the entry and exit sealing heads.

It is another object of the present invention to provide pneumatic cylinders that pressurize top and bottom sealing rolls between which the conveyor and yarn pass as they enter and exit the entrance and exit chambers.

It is another object of the present invention to provide top and bottom lamellas that include a two-piece machined base plate that provides increased clamping force.

It is another object of the present invention to provide pneumatic cylinders that are adapted to pressurize the top and bottom lamellas.

It is another object of the present invention to provide pneumatic cylinders that engage side plates for sealing off the ends of the top and bottom sealing rolls.

It is another object of the present invention to provide gib assemblies that include a fixed base with one or more floating gibs attached to the base of the sealing head apparatus to control and accommodate vertical and radial movement of the top and bottom sealing rolls without unacceptable pressure loss.

It is another object of the present invention to provide an integrated air supply reservoir that maintains system pressure to the pneumatic cylinders pressurizing the sealing heads in the event of a loss of pneumatic air supply and/or electrical power supply.

These and other objects and aspects are achieved by providing a continuous process heat set tunnel for setting yarn that includes a heat set tunnel adapted to extend longitudinally along a supporting floor surface and including an entrance end and an entrance sealing roll assembly and an exit end and an exit sealing roll assembly. An interconnected entrance cooling section, yarn steaming chamber and exit cooling section is positioned intermediate the entrance sealing roll assembly and the exit sealing roll assembly. An endless conveyor belt is adapted to transport yarn into, through and out of the heat set tunnel. An entrance sealing head is provided for sealing the entrance end of the heat set tunnel against loss of steam and pressure, and an exit sealing head is provided for sealing the exit end of the heat set tunnel against loss of steam and pressure. The entrance sealing head and the exit head sealing head each include a sealing roll frame for being mounted in heat-sealing relation adjacent the end opening, a bottom sealing roll mounted for rotation in the sealing roll frame and a top sealing roll mounted for rotation in the sealing roll frame and above the bottom sealing roll in roll surface contact with the bottom sealing roll along respective laterally-extending roll widths and defining a nip between which a yarn-transporting conveyor is adapted to pass. The top sealing roll and the bottom sealing roll are interconnected in a respective driving and driven configuration relative to each other, and a prime mover assembly is adapted to provide rotation to the driving one of the top sealing roll and the bottom sealing roll for passing the conveyor through the nip. A top lamella engages the top sealing roll along its width to prevent escape of steam and pressure from the heat set line past the top sealing roll and a bottom lamella engages the bottom sealing roll along its width to prevent the escape of steam and pressure from the heat set line past the bottom sealing roll.

First and second laterally-spaced pneumatic sealing roll cylinders are carried by the sealing roll frame for exerting a sealing force against the top sealing roll, the conveyor and the bottom sealing roll. At least first and second top pneumatic lamella sealing cylinders are mounted on the sealing roll frame for exerting against the top lamella a sealing force against the roll surface of the top sealing roll, and at least first and second bottom pneumatic lamella sealing cylinders are mounted on the sealing roll frame for exerting against the bottom lamella a sealing force against the roll surface of the bottom sealing roll.

According to another aspect of the invention, first, second and third top lamella sealing cylinders are mounted on the sealing roll frame between the first and second laterally-spaced pneumatic sealing roll cylinders.

According to another aspect of the invention, first, second and third bottom lamella sealing cylinders are mounted on a bottom frame of the sealing roll frame.

According to another aspect of the invention, first, second and third top lamella sealing cylinders are mounted on the sealing roll frame between the first and second laterally-spaced pneumatic sealing roll cylinders, and first, second and third bottom lamella sealing cylinders are mounted on a bottom frame of the sealing roll frame.

According to another aspect of the invention, a plurality of side pneumatic cylinders are mounted on the sealing roll frame for exerting a sealing force against opposing ends of the top sealing roll and the bottom sealing roll.

According to another aspect of the invention, the plurality of side pneumatic cylinders exert a sealing force in a direction perpendicular to the force applied by the first and second laterally-spaced pneumatic sealing roll cylinders carried by the sealing roll frame for exerting a sealing force against the top sealing roll.

According to another aspect of the invention, an electronic pneumatic circuit is adapted to permit pressure values for the first and second laterally-spaced pneumatic sealing roll cylinders, the at least first and second top pneumatic lamella sealing cylinders and the at least first and second bottom pneumatic lamella sealing cylinders to be independently and variably set to either the same or different pressure values.

According to another aspect of the invention, an integrated compressed air supply reservoir is provided for maintaining pressure to the first and second laterally-spaced pneumatic sealing roll cylinders, the at least first and second top pneumatic lamella sealing cylinders and the at least first and second bottom pneumatic lamella sealing cylinders upon a loss of pneumatic air supply pressure and/or electrical power supply. An electronically controlled pneumatic circuit is provided that maintains a pneumatic connection between the air supply reservoir and a all sealing cylinders in a closed condition during normal operation and that is opened upon a loss of plant pneumatic pressure and/or electrical power supply to maintain sealing cylinder pressure.

According to another aspect of the invention, a plurality of independent pneumatic circuits are provided for supplying pressures to selected groups of the first and second laterally-spaced pneumatic sealing roll cylinders, the at least first and second top pneumatic lamella sealing cylinders, the at least first and second bottom pneumatic lamella sealing cylinders and a plurality of side pneumatic cylinders exerting a sealing force in a direction perpendicular to the force applied by the first and second laterally-spaced pneumatic sealing roll cylinders carried by the sealing roll frame for exerting a sealing force against the top sealing roll upon a loss of pneumatic air supply pressure.

According to another aspect of the invention, a sealing head for sealing an end of a heat set tunnel against loss of steam and pressure is provided, and includes a sealing roll frame for being mounted in heat-sealing relation adjacent the end opening, a bottom sealing roll mounted for rotation in the sealing roll frame, and a top sealing roll mounted for rotation in the sealing roll frame and above the bottom sealing roll in roll surface contact with the bottom sealing roll along respective laterally-extending roll widths and defining a nip between which a yarn-transporting conveyor is adapted to pass. The top sealing roll and the bottom sealing roll are interconnected in a respective driving and driven configuration relative to each other and a prime mover assembly is adapted to provide rotation to the driving one of the top sealing roll and the bottom sealing roll for passing the conveyor through the nip. A top lamella engages the top sealing roll along its width to prevent escape of steam and pressure from the heat set line past the top sealing roll, and a bottom lamella engages the bottom sealing roll along its width to prevent the escape of steam and pressure from the heat set line past the bottom sealing roll. First and second laterally-spaced pneumatic sealing roll cylinders are carried by the sealing roll frame for exerting a sealing force against the top sealing roll, the conveyor and the bottom sealing roll. At least first and second top pneumatic lamella sealing cylinders are mounted on the sealing roll frame for exerting against the top lamella a sealing force against the roll surface of the top sealing roll, and at least first and second bottom pneumatic lamella sealing cylinders mounted on the sealing roll frame for exerting against the bottom lamella a sealing force against the roll surface of the bottom sealing roll.

According to another aspect of the invention, the bottom sealing roll is mounted for rotation about a fixed position axis of rotation and the top bottom sealing roll is mounted for rotation about a variable position axis of rotation relative to the bottom sealing roll.

According to another aspect of the invention, first and second gibs are mounted on the sealing roll frame in radial alignment with respective first and second laterally spaced-apart bearing blocks in which the top and bottom sealing rolls are mounted for rotation, each of the first and second gibs being adapted to engage the spaced-apart bearing blocks for allowing vertical motion of the top and bottom sealing rolls relative to each other while restricting longitudinal, axial, or rotational movement of the bearing blocks.

According to another aspect of the invention, the first and second gibs each include at least two vertically-spaced floating gib segments adapted to move independently of each other in response to vertical movement of the top sealing roll relative to the bottom sealing roll.

According to another aspect of the invention, the first and second gibs are each affixed to a stationary base by at least one spring element that passively applies a uniform and repeatable contact force within a range upon a slidable connection to a bearing block through which the top and bottom sealing rolls rotate, the slidable connection and contact force restricting longitudinal, axial or rotational movement of the bearing block while permitting controlled vertical and longitudinal movement of the bearing block.

According to another aspect of the invention, the first and second laterally-spaced pneumatic sealing roll cylinders are adapted to lift the top sealing roll vertically out of sealing contact with the bottom sealing roll.

According to another aspect of the invention, a sealing head for sealing an end of a heat set tunnel against loss of steam and pressure is provided, and includes a sealing roll frame for being mounted in heat-sealing relation adjacent the end opening, a bottom sealing roll mounted for rotation in the sealing roll frame, and a top sealing roll mounted for rotation in the sealing roll frame and above the bottom sealing roll in roll surface contact with the bottom sealing roll along respective laterally-extending roll widths and defining a nip between which a yarn-transporting conveyor is adapted to pass. The top sealing roll and the bottom sealing roll are interconnected in a respective driving and driven configuration relative to each other, and a motor and a connected gear train are provided for driving one of the top sealing roll and the bottom sealing roll and for passing the conveyor through the nip. A top lamella is provided for engaging the top sealing roll along its width to prevent escape of steam and pressure from the heat set line past the top sealing roll, and a bottom lamella is provided for engaging the bottom sealing roll along its width to prevent the escape of steam and pressure from the heat set line past the bottom sealing roll. First and second laterally-spaced pneumatic sealing roll cylinders are carried by the sealing roll frame for exerting a sealing force against the top sealing roll, the conveyor and the bottom sealing roll, and three pneumatic lamella sealing cylinders are mounted on the sealing roll frame between and in lateral alignment with the first and second laterally-spaced pneumatic sealing roll cylinders for exerting against the top lamella a sealing force against the roll surface of the top sealing roll. Three pneumatic lamella sealing cylinders are mounted on the sealing roll frame for exerting against the bottom lamella a sealing force against the roll surface of the bottom sealing roll, and four side pneumatic cylinders are mounted on the sealing roll frame for exerting a sealing force against opposing ends of the top sealing roll and the bottom sealing roll in a direction perpendicular to the force applied by the first and second laterally-spaced pneumatic sealing roll cylinders.

BRIEF DESCRIPTION OF THE DRAWINGS

The following drawings are referred to in the Detailed Description of a Preferred Embodiment and Best Mode.

DETAILED DESCRIPTION OF A PREFERRED EMBODIMENT AND BEST MODE

Figure 1:
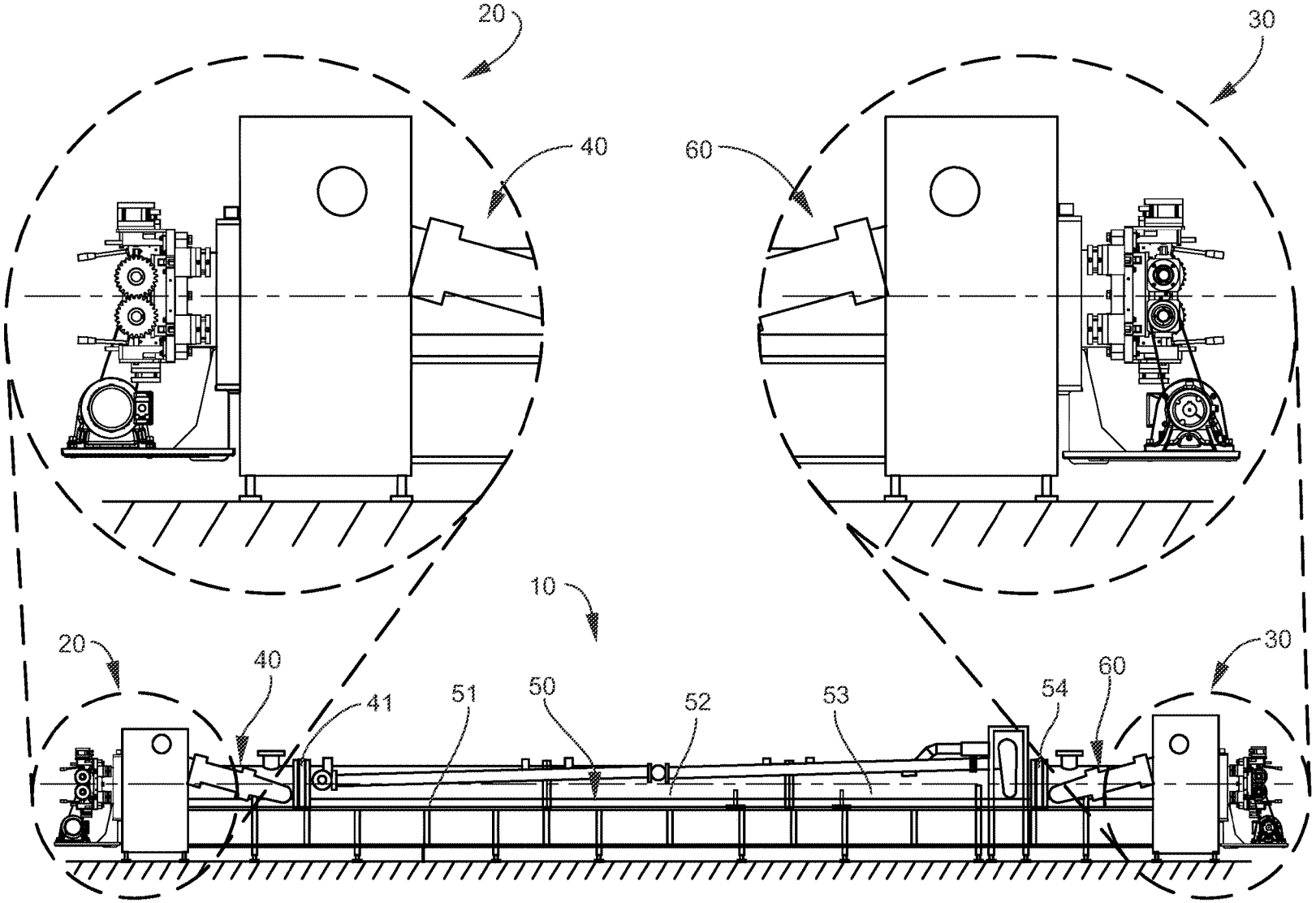
FIG. 1 is an overall side elevation of a machine for heat setting yarn in accordance with one preferred embodiment of the invention.

Referring now to FIG. 1 of the drawings, a heat set tunnel 10 according to the invention extends longitudinally along a supporting floor surface and includes on one end an entrance sealing roll assembly 20 and on the other end an exit sealing roll assembly 30. Downstream of the entrance sealing roll assembly 20 is an entrance cooling section 40 connected by a cool/heat transition 41 to a steaming chamber 50 comprised of tubular elongate entry, intermediate and exit heat set tunnel segments 51, 52 and 53, respectively. A heat/cool transition 54 interconnects the exit heat set tunnel segment 53 with an exit cooling section 60.

The treated yarn passes through a heat/cool transition 54 into an exit cooling section 60 which cools the yarn as it passes into and through an exit sealing roll assembly 30. The yarn is then conveyed to a winder, not shown, where the yarn is packaged on suitable yarn packages and is ready for further processing. The operation of the tunnel segments 51, 52 and 53 is well-known as disclosed in, for example, U.S. Pat. No. 7,219,516.

The entrance roll sealing assembly 20 is shown in detail in FIGS. 1-7. The exit roll sealing assembly 30 has the same construction and operates in synchrony with the sealing roll assembly 20. Further discussion is therefore directed to the entrance roll sealing assembly 20 as being also fully representative of the exit sealing roll assembly 30. The entrance roll sealing assembly 20 includes a top frame 70, and bottom frame 71 mounted to a back plate 74.

Figure 5:
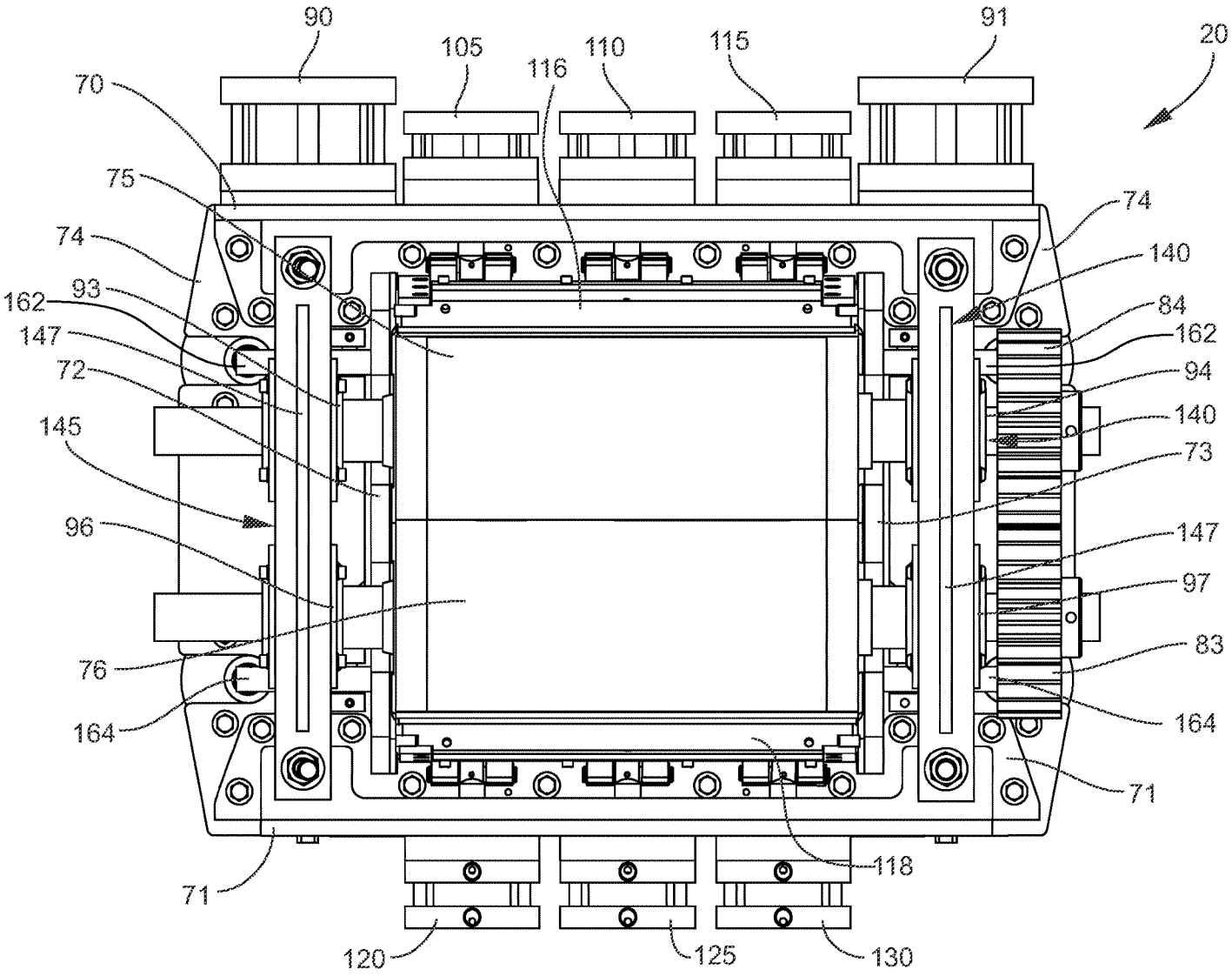
FIG. 5 is a is a front elevation of a sealing head with drive mechanism not shown for clarity in accordance with one preferred embodiment of the invention.
Figure 6:
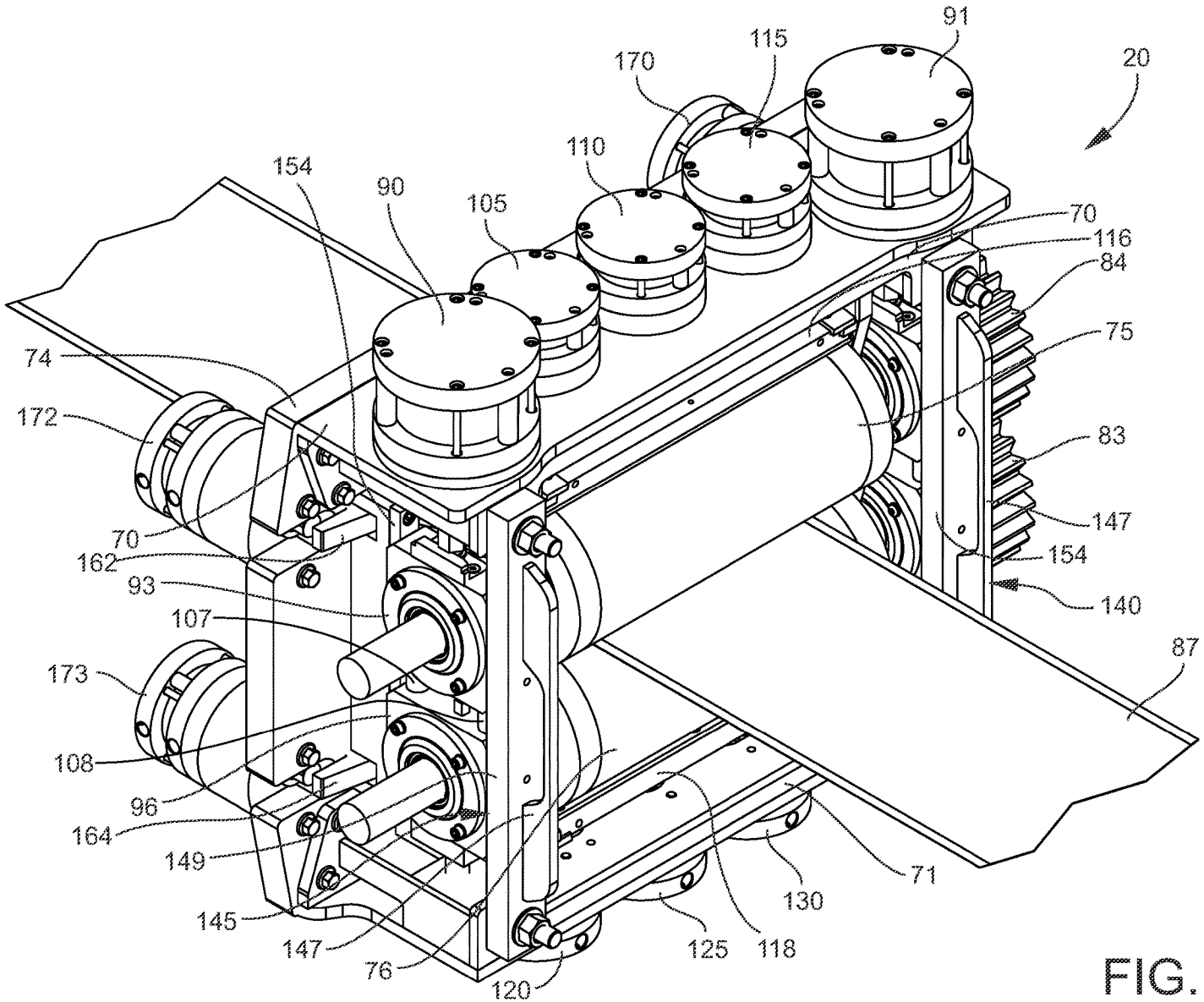
FIG. 6 is a perspective view of a sealing head with the drive mechanism not shown for clarity in accordance with one preferred embodiment of the invention.

As is best shown in FIG. 5, these components collectively form a frame structure within which is mounted a top sealing roll 75 mounted in movable bearing blocks 93, 94 and a bottom sealing roll 76 mounted in stationary bearing blocks 96, 97 for rotation. The top and bottom sealing rolls 75 and 76 are each covered with a heat and pressure-resistant resilient material and define a nip at their respective axially-extending point of mutual contact through which a conveyor 87 passes, as is best shown in FIG. 6. This structure permits a modular pneumatically operated sealing head that will allow for a yarn mass of bulked textured yarn with a higher pile height and an increased density located primarily in the center portion of the conveyor belt 87 to accommodate heat setting of yarn products with reduced wear on lamellas and sealing rolls for increased productivity and more effective sealing at the entry and exit sealing heads, as further described below.

Figure 2:
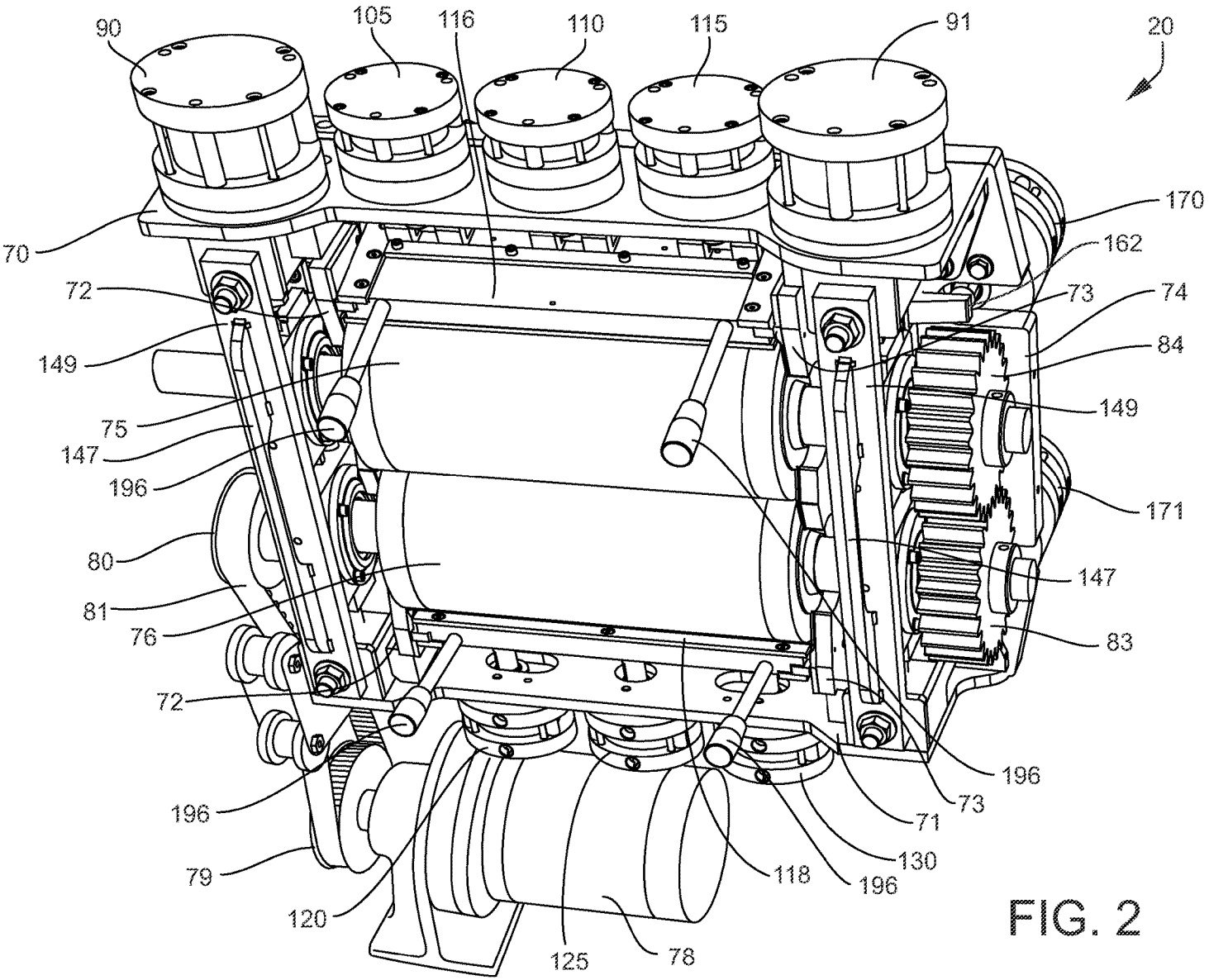
FIG. 2 is a front perspective view of a sealing head in accordance with one preferred embodiment of the invention.

According to FIG. 2, a motor 78 rotates a geared drive pulley 79 that rotates a geared driven pulley 80 by means of a timing belt 81. The driven pulley 80 rotates the bottom sealing roll 76. A drive gear 83 mounted for rotation with the bottom sealing roll 76 rotates a driven gear 84 mounted for rotation on the top sealing roll 75. The bottom sealing roll 76 is mounted in the frame structure in a vertically-fixed position. The top sealing roll 75 is mounted in the frame structure for limited vertical movement, further described below.

Also according to FIG. 2, the sealing pressure against the top and bottom sealing rolls 75 and 76 necessary to prevent the escape of tunnel pressure is provided by pneumatic cylinders 90 and 91 mounted on the top frame 70 to set the nip pressure between the sealing rolls 75 and 76 by vertically moving the top sealing roll 75 against the stationary bottom sealing roll 76. These pneumatic cylinders 90 and 91 also move the top sealing roll 75 out of sealing position once the pressure is relieved from the continuous heat set tunnel 10, if desired.

The top and bottom sealing rolls 75, 76 are supported by the bearing blocks 93, 94 and 96, 97, respectively. The sealing head design provides active controlled movement of the top sealing roll 75. This movement is limited to the vertical direction, as transverse and longitudinal movements are restricted by the fit of the bearing blocks 93, 94 to the gib assemblies 140.

Figure 4:
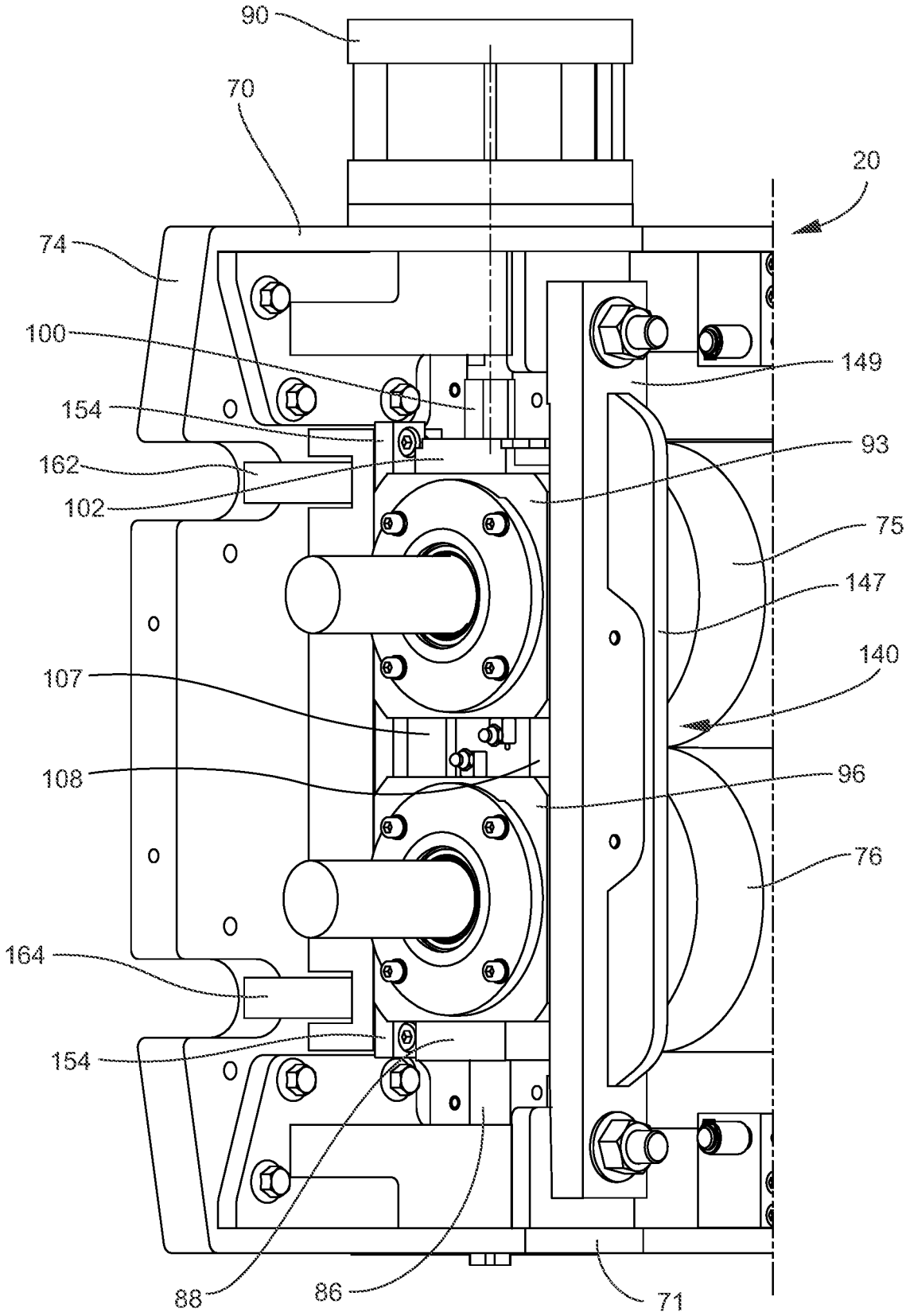
FIG. 4 is a fragmentary perspective elevation with parts broken away for clarity of a sealing head in accordance with one preferred embodiment of the invention.

As is shown in FIG. 4, the bottom sealing roll 76 is moveable to the extent that its vertical position can be changed using jack screws 86 at each bearing block 96, 97 to set desired elevation and level positions. Once these adjustments are completed, it is not intended for the bottom sealing roll 76 to move vertically during normal operation of the sealing head 20. Each jack screw 86 inserts into guide blocks 88, 89 fastened to the underside of the bearing blocks 96, 97, respectively.

The top sealing roll 75 is connected to the pneumatic cylinder 90, 91 to raise and lower the top sealing roll 75. As shown with reference to cylinder 90, rod end fitting 100 attached to pneumatic cylinder 90 engages with receiver block 102 attached to the top surface of the bearing block 93 using a key-and-groove configuration so that only vertical force inputs are transmitted to the bearing block 93, with no restrictive forces transmitted due to assembly misalignments that may be present in the transverse or longitudinal directions. This same description is also applicable to the bearing block 94.

As shown in FIGS. 5 and 6, the cylinders 90 and 91 also apply the force needed to generate clamping pressure that develops between the upper and lower sealing rolls 75, 76 in compression across their transverse width. The pliable material of the sealing rolls 75, 76 allows for compression when presented with this force, but the amount of compression, expressed as the distance traveled by the top sealing roll 75 in downward travel beyond the theoretical position of the top roll shaft center as the top sealing roll 75 circumference begins to contact the bottom sealing roll 76 circumference, is limited to preserve proper engagement of the drive gear set 83, 84 operating between the sealing roll pair 75, 76.

As best shown in FIG. 6, limit blocks 107, 108, each having a precise and consistent height, are mounted to respective bearing blocks 93, 94 so that downward travel is limited as the top bearing blocks 93, 94 contact the limit blocks 107, 108. The length of the limit blocks 107, 108 is determined to allow for the top and bottom sealing rolls 75, 76 to generate a reliable level of clamping pressure while allowing the gears 83 and 84 to operate free of undue loading or excessive wear to the gear teeth.

In normal operation, the pneumatic pressure supply for the cylinders 90 and 91 is on a separate supply from the pneumatic lamella cylinders 105, 110 and 115, as is the pressure supply for the side plate seal cylinders 170, 171, 172 and 173. The pneumatic cylinders 105, 110 and 115 exert a downward pressure on a top lamella 116 to seal the top lamella 116 against the top sealing roll 75. The pneumatic lamella cylinders 120, 125 and 130 are mounted on the bottom frame 71 for applying pressure to a bottom lamella 118 to seal the bottom lamella 118 against the bottom sealing roll 76. The bottom sealing roll 76 is mounted in stationary bearing blocks 96 and 97. It is intended that the number of pneumatic cylinders applying pressure to the top and bottom lamellas 116 and 118 is modular and therefore variable, and may be decreased or increased depending on the width of the conveyor 87 and/or the thickness of the yarn being transported through the heat set tunnel 10. This modular design is important as industry will continue to seek means to increase productivity and reduce production costs. Without the development of a wider conveyor belt system as a means to increase yarn mass density, the sections of the continuous autoclave must become longer, requiring additional labor for operating the equipment. The application of a wider conveyor belt with an increased yarn mass, especially with textured yarn, allows the conveyor belt speed through the heat set tunnel 10 to be reduced, therefore offering a shorter overall process length for the same amount of dwell time.

Further details of the construction and operation of the lamellas are provided below.

Figure 7:
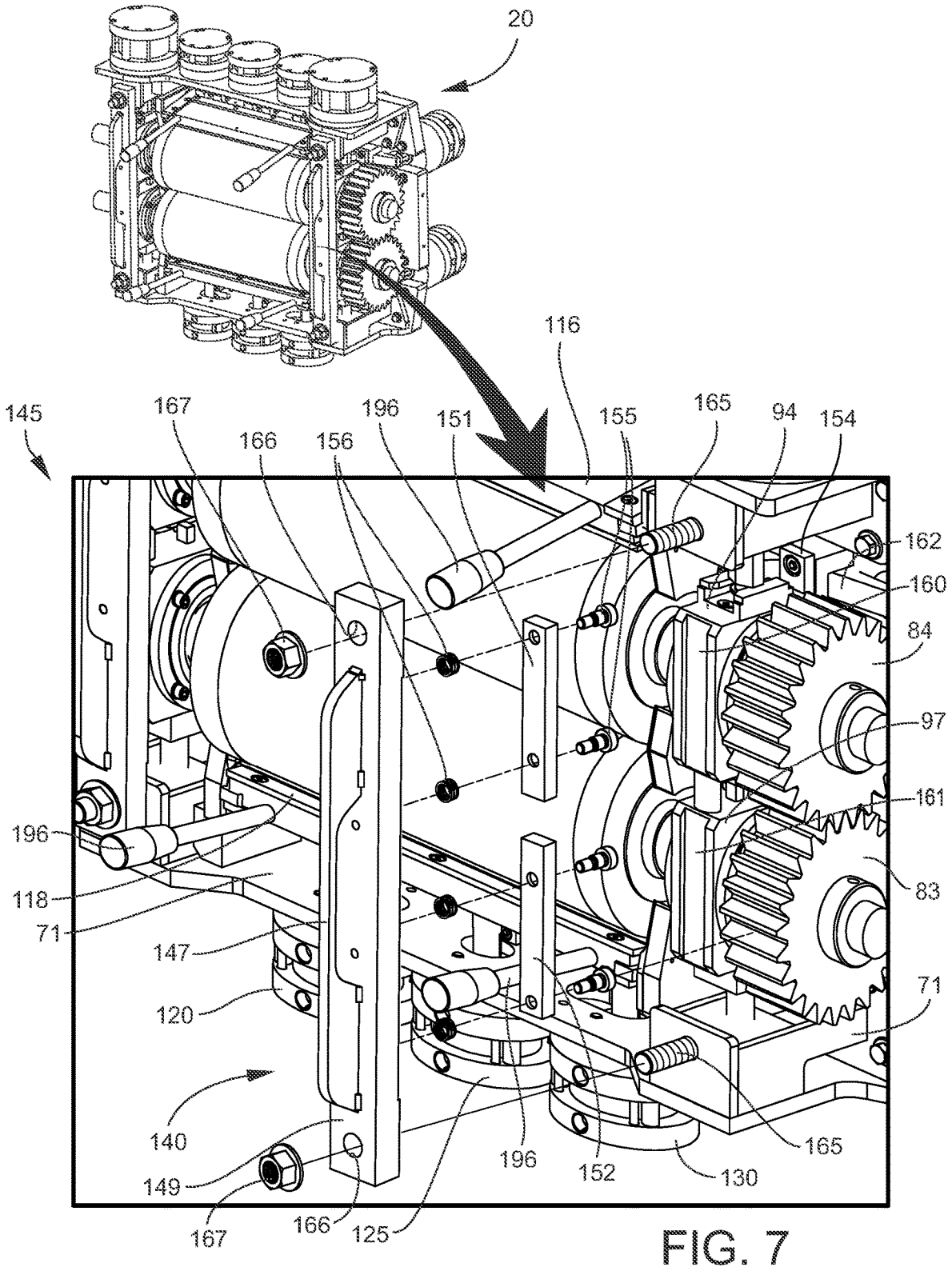
FIG. 7 is a perspective view of a sealing head in accordance with one preferred embodiment of the invention, and including a fragmentary enlarged and partially-exploded view of the floating gib component of the sealing head.
Figure 8:
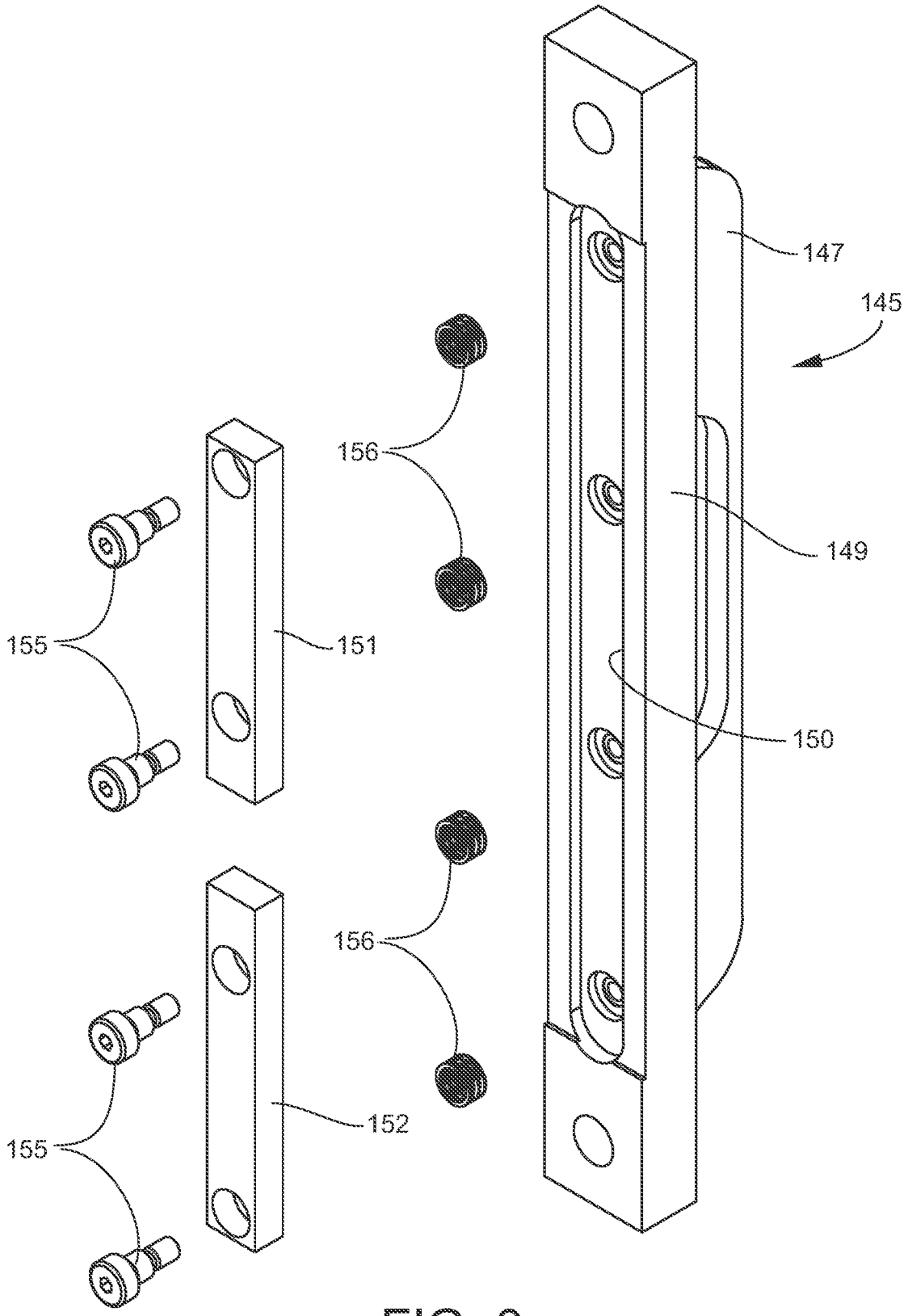
FIG. 8 is an exploded view of the floating gib component of the sealing head in accordance with one preferred embodiment of the invention.

Referring now to FIGS. 5-8, a pair of gib assemblies 140, 145 are mounted to span the top and bottom frames 70 and 71, respectively, of the sealing head 20. As shown in FIG. 7, the gib assembly 140 is shown in an exploded view and is representative of the other of the pair of gib assemblies 145. The gib assembly 140 is mounted to span the top and bottom frames 70 and 71, and includes a handle 147 mounted to base 149 that includes an elongate channel 150 extending along its length. A pair of floating gibs 151 and 152 is mounted in the elongate channel 150 in a manner that permits a limited amount of independent movement. At assembly, the floating gibs 151 and 152 are placed into the elongate channel 150 of base 149 and fastened through an array of slidable connections, such as pins 155. The floating gibs 151 and 152 are also supported by an array of spring elements 156 placed between the floating gibs 151, 152 and the elongate channel 150 of base 149 in a manner to preload the spring elements 156 so the floating gibs 151 and 152 are not in a loose condition relative to the base 149 when the gib assemblies 140, 145 are removed.

As the floating gibs 151, 152 of the gib assembly 140 are placed into guide tracks 160, 161, the gib face surfaces contact the face surface of the guide tracks 160, 161. Once the floating gibes 151, 152 are in contact and aligned with the block guide tracks 160, 161, the base 149 is secured to the sealing head frames 70, 71 by bolts 165 that extend through bores 166 in the base 149 and are captured by nuts 167. The action of the bolts 165 and nuts 167 generate force as the gib 140 progressively compresses the array of spring elements 156 further until the base 149 is securely fastened to the sealing head frames 70, 71, passively applying a uniform and repeatable contact force within a predictable and sufficient range between the gib assembly 140 and the guide tracks 160, 161. These contact surfaces are in full contact under the resultant applied force allowing desired vertical motion while limiting the possibility of unintended clearances that fail to restrain the bearing blocks 94 and 97 from unwanted longitudinal, axial, or rotational movement. These desired conditions are achieved using interchangeable parts without need for specialized skill in assembling the floating gibs 151, 152 and sliding mechanisms. This design also promotes interchangeability of any floating gib assembly among any number of sealing head assemblies, as unique fit relationships between parts are not present. Again note that the above description is equally applicable to the gib assembly 145 positioned on the left-hand side of the sealing head 20, as shown in, for example, FIGS. 6 and 7. As also shown in FIGS. 4 and 7, a fixed gib 154 is mounted to the back plate 74 and engages the guide tracks opposite to the guide tracks 160, 161 of the bearing blocks 93, 96 and 94, 97 as shown in FIG. 7.

Figure 9:
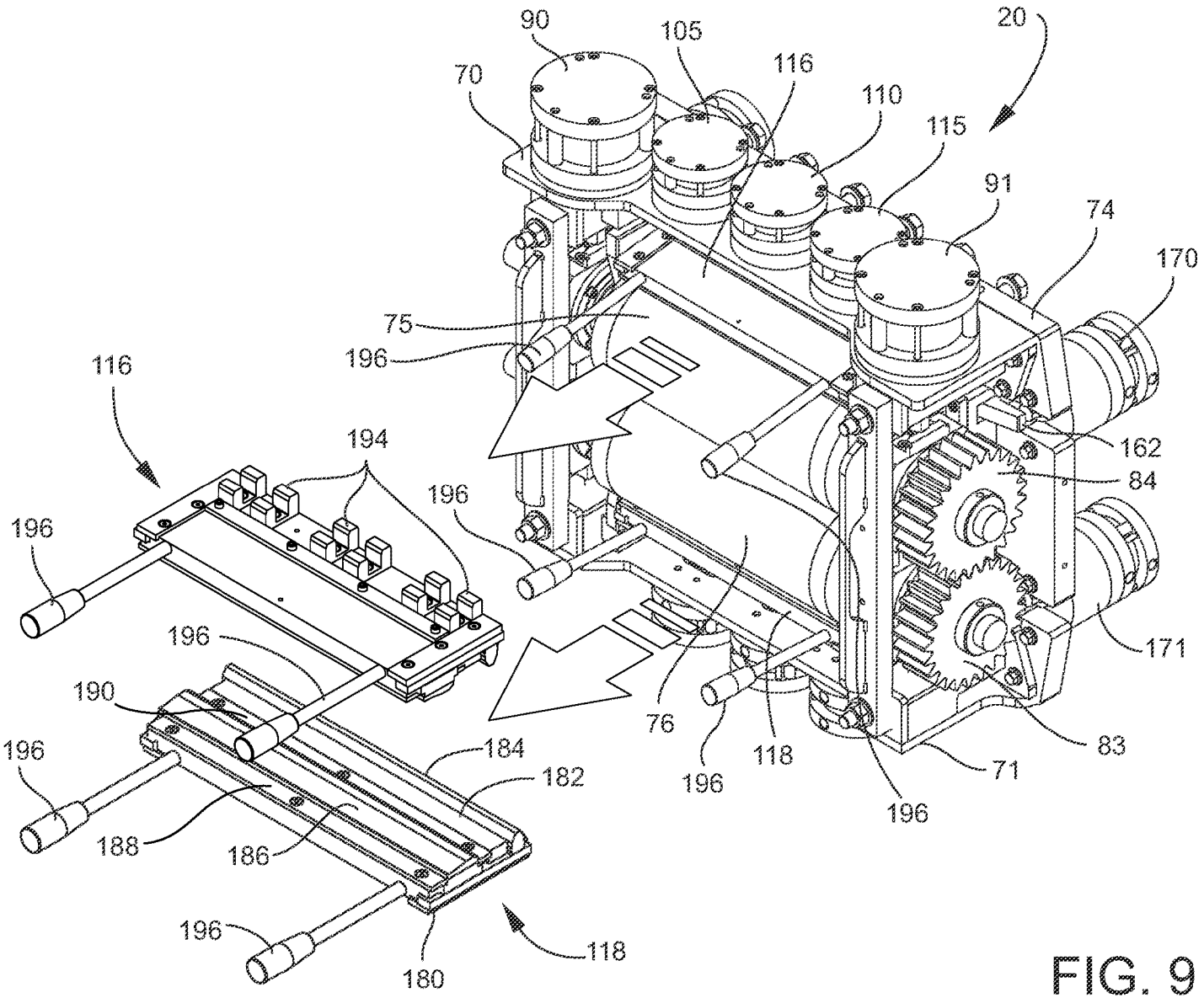
FIG. 9 is a perspective view the sealing head in accordance with one preferred embodiment of the invention, with the top and bottom lamellas shown both installed and removed positions.
Figure 10:
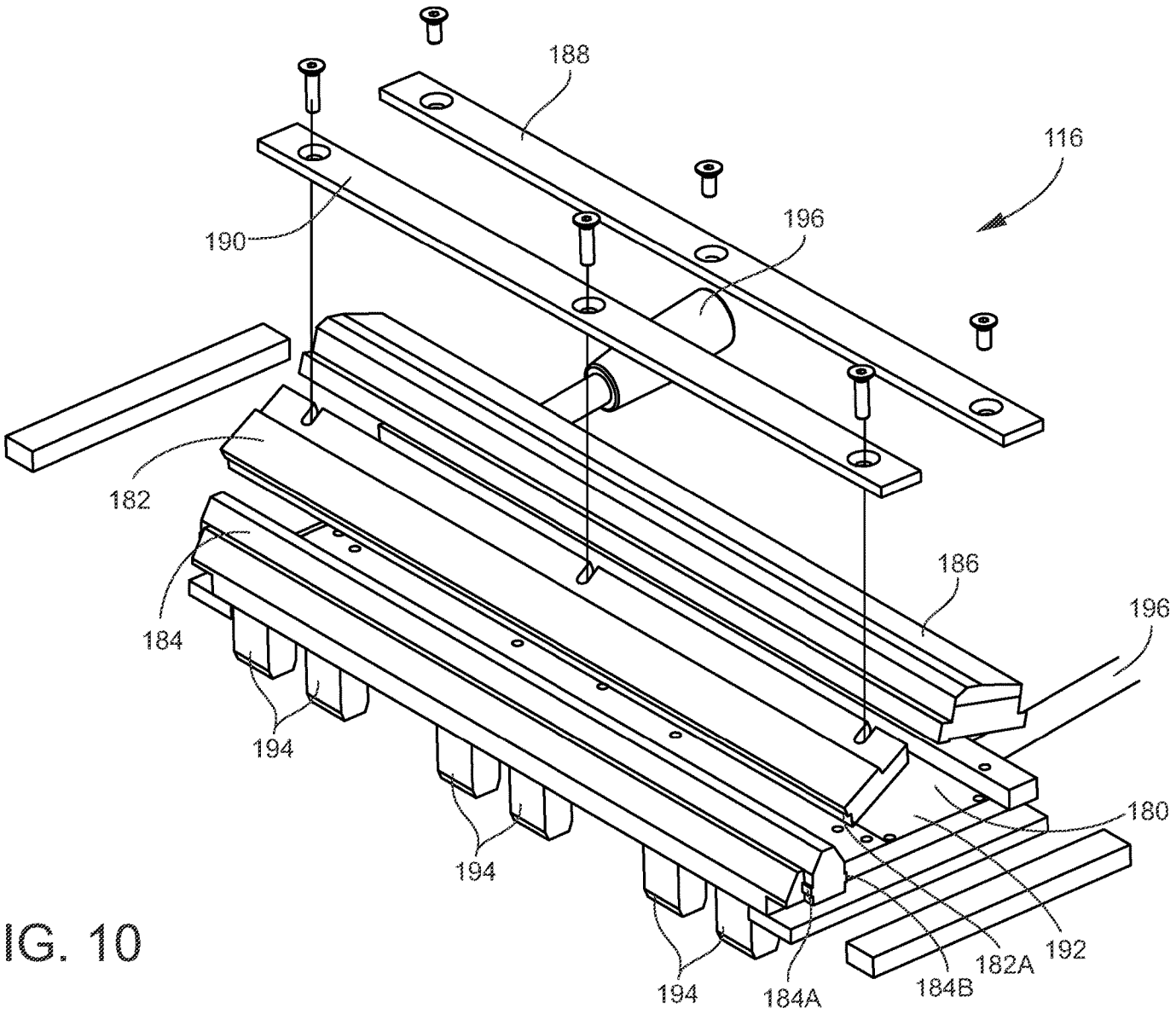
FIG. 10 is an exploded perspective view of a two-piece lamella in accordance with one preferred embodiment of the invention.

Referring now to FIGS. 2, 7 and 9, the top and bottom lamellas 116, 118 are urged against the top side of the top sealing roll 75 and bottom side of the bottom sealing roll 76, respectively, and seal against pressure escaping around the top of the top roll 75 and the bottom of the bottom roll 76. In keeping with the intention to provide modular accommodation to varying widths of yarn on the conveyor 87 and varying widths of the conveyor 87 itself, in the particular embodiment disclosed in this application the three pneumatic cylinders 105, 110 and 115 are spaced laterally across the width of the sealing head 20 and exert uniform pressure across the width of the top lamella 116. Similarly, three pneumatic cylinders 120, 125 and 130 are spaced laterally across the width of the sealing head 20 and exert uniform pressure across the width of the bottom lamella 118. The flexibility of this modular pneumatic sealing head 20 allows for the removal of pneumatic cylinders and/or moving the pneumatic cylinders across the width of the top and bottom frame components. In addition, the capability is available to supply different pneumatic pressures to each individual pneumatic cylinder 105, 110, 115, 120, 125 and 130 to collectively apply force to the lamella plates 116 and 118 for any given conveyor belt width and yarn mass. This arrangement is superior to the existing industry standard sealing heads and allows maximum flexibility to accommodate variables such as yarn thickness and conveyor belt width.

Figure 11:
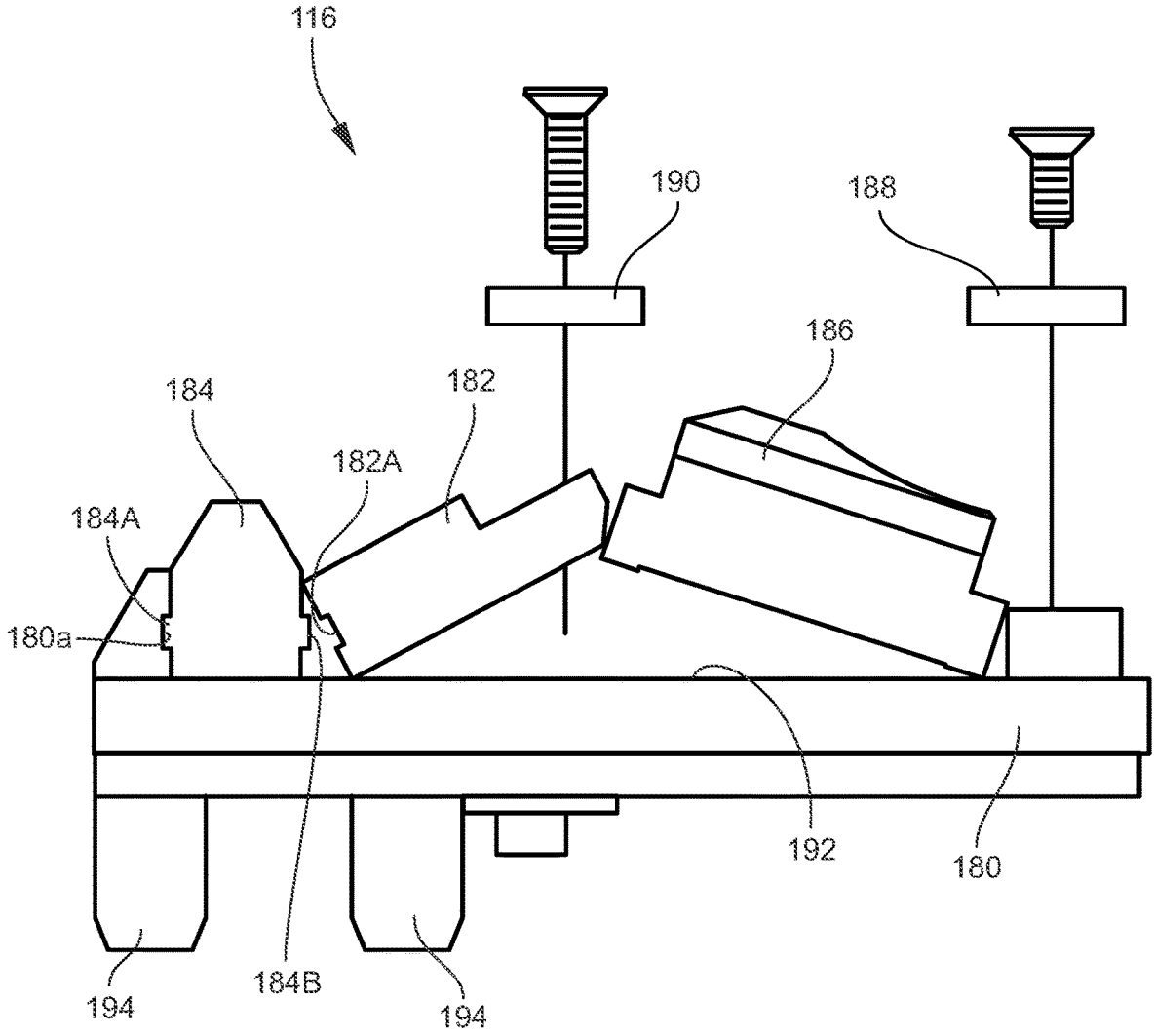
FIG. 11 is an exploded side elevation view of a two-piece lamella in accordance with one preferred embodiment of the invention.
Figure 12:
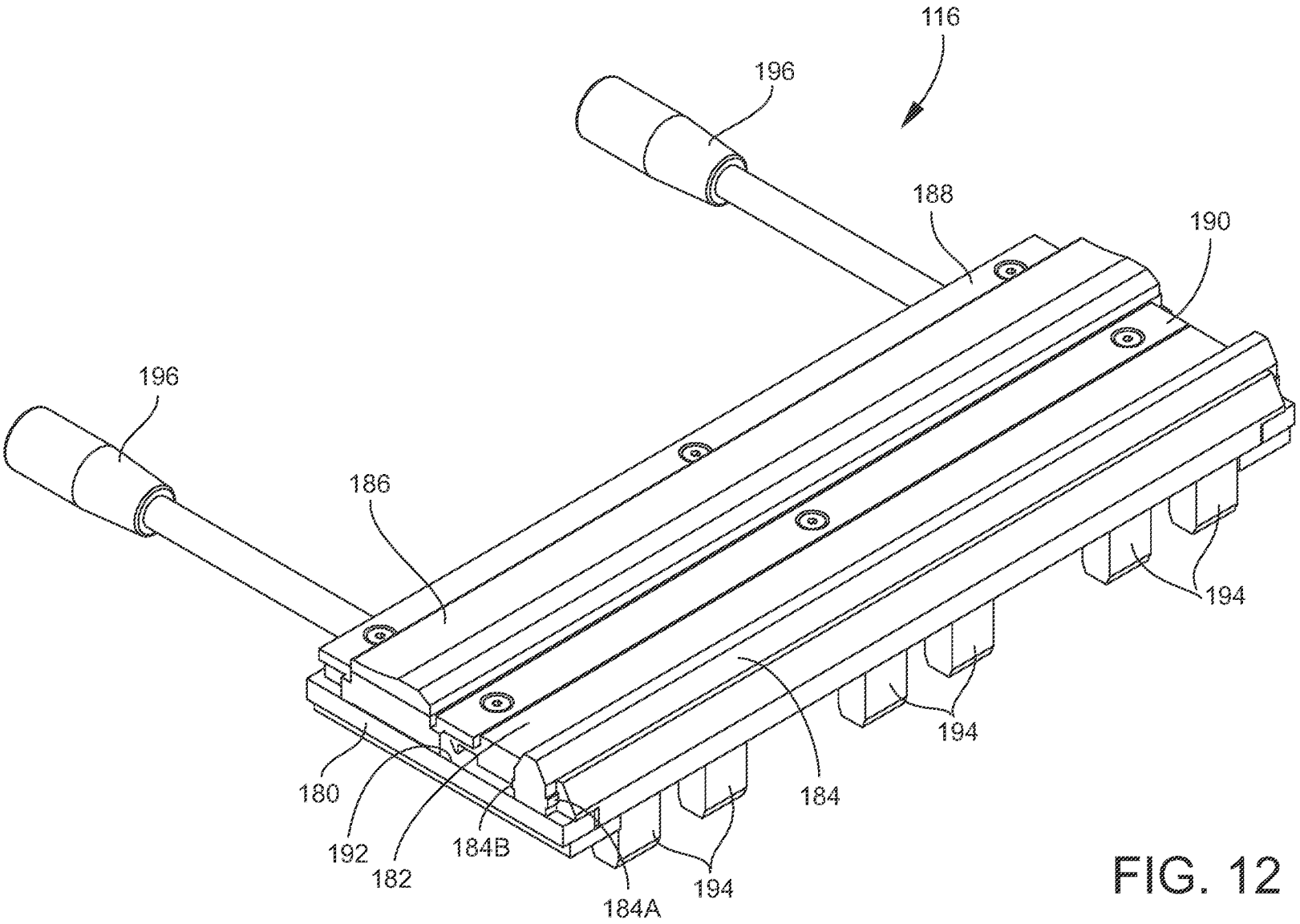
FIG. 12 is a perspective view of a two-piece lamella in accordance with one preferred embodiment of the invention.

As with other components, the following description of the top roll lamella 116 is generally applicable to the bottom roll lamella 118, as well. As is well-known, a lamella provides sealing pressure against an adjacent surface against which it is forced. The lamella 116 locks into place between the top of the top sealing roll 75 and the top lamella pneumatic cylinders 105, 110 and 115. The lamella 116 includes a base plate 180, a clamping strip 182, a fixed seal 184, a lamella seal 186 and two hold down strips 188, 190. The base plate includes a recess 192 into which the clamping strip 182 and the lamella seal 186 are positioned. As is shown by comparing FIGS. 11 and 12, the clamping strip 182 and the lamella seal 186 are together slightly wider than the width of the recess 192. By forcing the clamping strip 182 and the lamella seal 186 down into the recess 192, they snap into place to form a two-piece assembly, as shown in FIG. 12. The assembly is held in place by the two hold down strips 188, 190, also shown in FIG. 12. The clamping strip 182 also wedges the fixed seal 184 into its fixed position, where it is held in place by ribs 184*a*, 184*b* that fit into recesses 180*a* and 182*a* in the base plate 180 and the clamping strip 182. This modular design permits individual components of the lamella assemblies to be removed and replaced quickly and easily.

By further securing the lamella 116 and fixed seal 184 with additional clamping force, in case of a yarn lap up on a sealing roll and/or any of the situations described previously where there is a sudden loss of the seal of the continuous autoclave for whatever reason at an entry or exit sealing head, the rapid rate of pressure loss will be reduced by not having the lamella seal 186 and fixed seal 184 forcibly removed from the lamella assemblies.

Further to increasing the clamping force of the lamella and the fixed seal in place, this new design allows for the fixed seal to be removed easily without the use of a mallet. By removing three fasteners allows easy access to remove the fixed seal 184 and lamella 116 and at the same time, increasing the clamping force for each once assembled.

The top side of the lamella 116 includes a series of spaced-apart cleats 194 that are positioned between the top frame 70 and the top sealing roll 75. The pneumatic cylinders 105, 110 and 115 extend downwardly from the top frame 70 and are positioned between pairs of these cleats 194 and thereby lock the lamella 116 into a fixed position where the pneumatic cylinders 105, 110, and 115 bear directly down on the lamella 116, forcing the fixed seal 184 and the lamella seal 186 into a sealing position against the surface of the top sealing roll 75. See also FIG. 2.

The bottom side of the lamella 118 is constructed in the same manner to seal against the bottom of the bottom sealing roll 76 under the pressure exerted by the pneumatic cylinders 120, 125 and 130. See FIG. 2.

Finally, the lamellas 116 and 118 each include outwardly extending handles 196 that facilitate placement and removal of the lamellas 116 and 118 into and out of operative position against the sealing rolls 75 and 76 as described above.

Other iterations or combinations are possible, and more or fewer pneumatic cylinders may be used to seal a lamella to the surface of a sealing roll. A different number of pneumatic cylinders may be used to seal the top sealing roll 75 than for the bottom sealing roll 76, and the spacing of the pneumatic cylinders may vary top to bottom. The flexibility of this modular design includes the capability to supply different pneumatic pressures to each individual pneumatic cylinder applying force to the lamella plates for any given conveyor belt width and yarn mass which is superior to the existing industry standard sealing heads of today, especially for increased pile heights of textured yarn.

Figure 13:
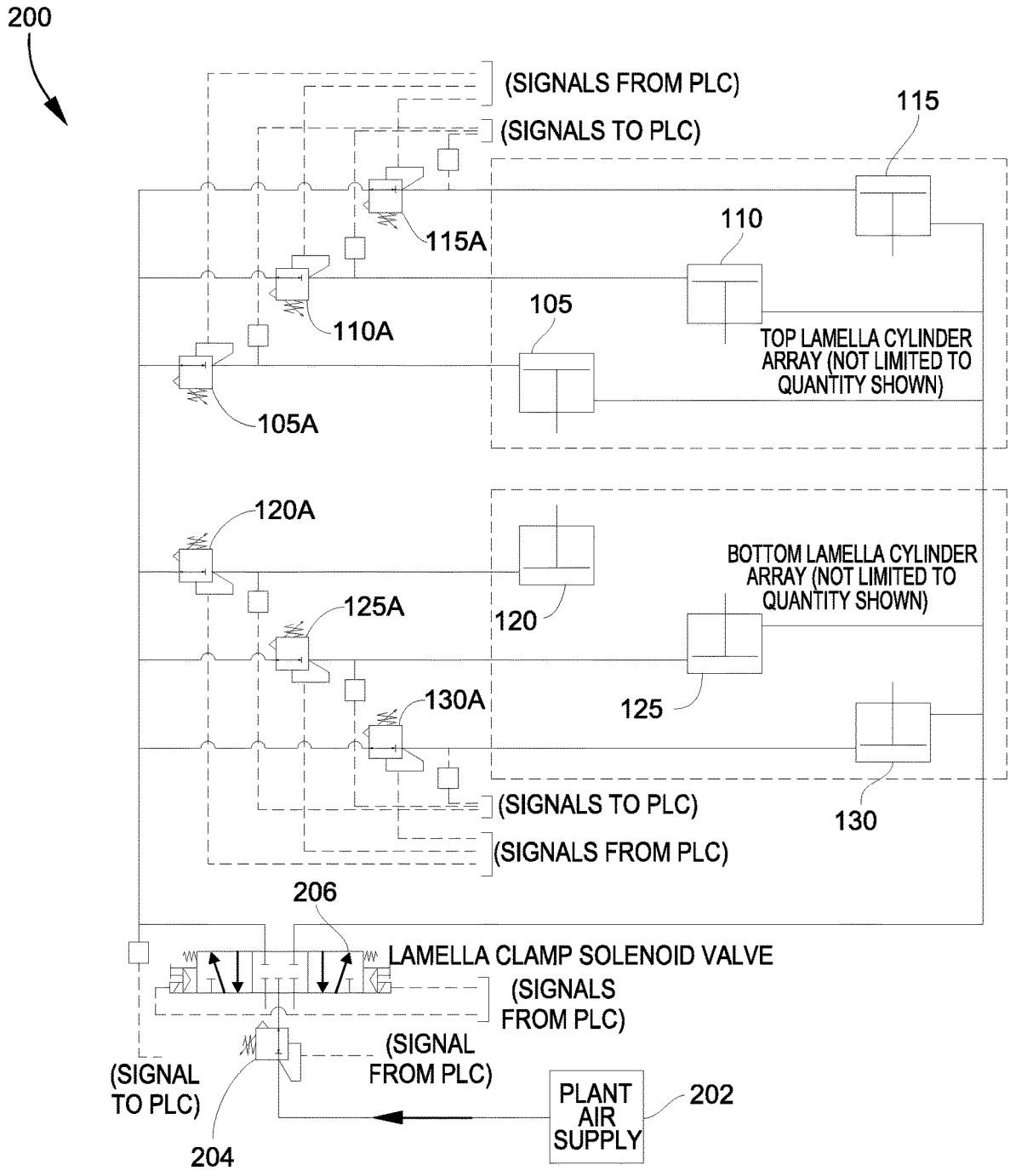
FIG. 13 is diagram of a lamella clamp circuit that provides independent variable pressure to the top and bottom lamellas.

Referring now to FIG. 13, a circuit 200 for a pneumatic control system allowing the supply of independently regulated pneumatic pressures to individual lamella cylinders 105, 110, 115, 120, 125 and 130 is shown. Each lamella cylinder 105, 110, 115, 120, 125 and 130 is controlled by PLC signals. A supply of pressurized air 202 passes through a pressure regulator 204 and a lamella clamp solenoid valve 206. Individual PLC signals indicative of a specific pneumatic pressure to any one of the pneumatic cylinders 105, 110, 115, 120, 125 and 130 determine the pressure at each of the cylinders 105, 110, 115, 120, 125 and 130, with a feedback loop sending signals indicative of the pneumatic pressure back to the PLC. Pressure regulators 105A, 110A, 115A, 120A, 125A and 130A maintain the pressure in the respective cylinders 105, 110, 115, 120, 125 and 130 at a predetermined value, which may be a uniform pressure or independently variable.

From the above description it is apparent that the entire continuous heat set process is not fully sealed, but permits a controlled leak in several areas. The system is never completely sealed. Pneumatic pressure is supplied to the entry and exit cooling chambers 40 and 60 at a higher pressure than the steam pressure required in the heat setting sections 51, 52 and 53 to keep these heat setting sections 51, 52, 53 of the process isolated to heat set the yarn, and to protect the entry and exit sealing heads 20 and 30 from the high temperature steam in the heat setting sections 51, 52 and 53 of the process. An automatically controlled pneumatic shuttle valve, not shown, varies the air pressure supplied to the entry and/or exit cooling chambers 40 and 60, using feedback from temperature probes in the transition plates 41 and 54 to control the position of the volume of pressurized steam, known in the industry as a "steam bubble", so that the "steam bubble" is confined within the heat setting sections 51, 52 and 53. Some steam-air mixture leaks out of the entry and exit cooling chambers 40 and 60 at the sealing heads 20 and 30, as well as some air pressure that leaks into the heat setting sections 51, 52 and 53 where the conveyor belt 87 and yarn products transverse between the entry cooling chamber 40 into the entry heat setting section 51 and where the conveyor belt 87 and yarn products transverse between the exit heat setting section 53 and the exit cooling chamber 60. As can be understood by those in the art, a proportional steam valve is constantly operating to supply a variable quantity of sparge steam into the sump of the heat setting sections 51, 52 and 53 to maintain the constant temperature set-point for the heat setting process, to account for the yarn mass on the conveyor belt 87 moving through the system taking away heat as it exits the heat setting section 5, as well as for any leaking of air into the heat setting sections 51, 52 and 53 from by the entry and exit cooling chambers 40 and 60.

As a function of the overall continuous heat setting process, the sealing rolls 75, 76, the lamellas 116, 118 and side plates 72 and 73 are inherently lubricated when the system is pressurized due to the "controlled leak" of steam and water around these elements described above, and especially when yarn mass is being transported through pre-bulking stage on the conveyor belt prior to entering the continuous heat setting sections 51, 52 and 53.

Figure 3:
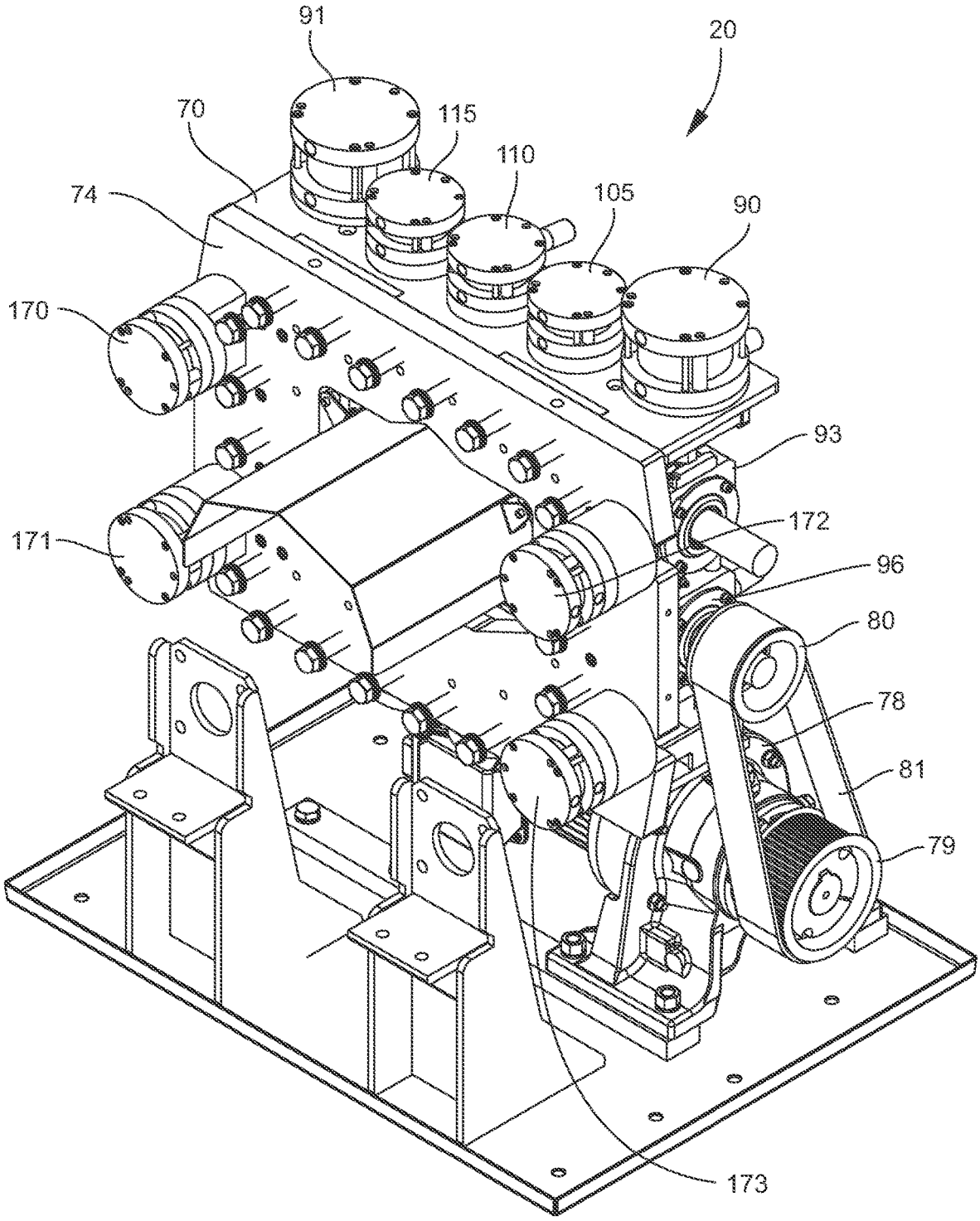
FIG. 3 is a rear perspective view of a sealing head in accordance with one preferred embodiment of the invention, with parts broken away for clarity.

As best shown in FIG. 3, side pneumatic cylinders 170, 171, 172 and 173 are mounted to the back plate 74 and apply force through pivoting levers 162, 164 to press side plates 72, 73 against the opposing ends of the sealing rolls 75, 76.

Figure 14:
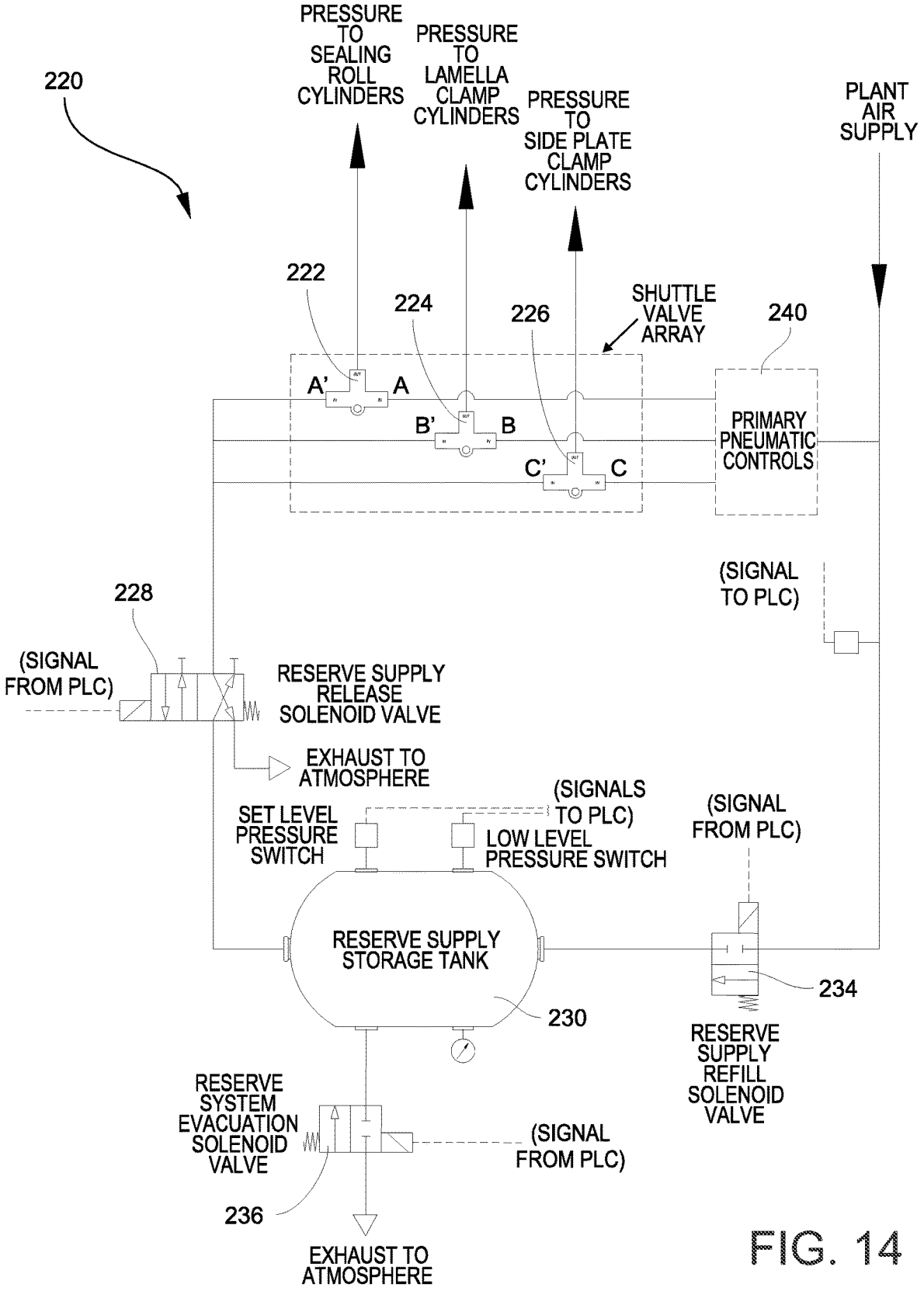
FIG. 14 is a diagram of a sealing head safety circuit for supplying back-up air pressure to the pneumatic cylinders.

Referring now to FIG. 14, the schematic illustrates a pneumatic system 220 to provide for an adequate supply of pressurized air to the three sets of clamping cylinders—the sealing roll cylinders 90, 91, the lamella cylinders 105, 110, 115, 120, 125, 130 and the side pneumatic cylinders 170, 171, 172 and 173—to maintain their position, and the associated sealing function of each component, in the event of an electrical power loss, or partial or full loss of pressure in the plant air system. In normal operation, all of the pneumatic clamping cylinders are supplied pressurized plant air that has been processed by the primary pneumatic controls into three independent pneumatic circuits, each having a dedicated manual or electronic pressure regulation control.

The schematic illustrates three independent circuits supplying pressures A, B and C. Each independent circuit includes a passive shuttle valve 222, 224, 226 respectively, that permits the greater of two pressures presented to each shuttle valve, for example pressures A and A', B' and B, and C' and C, to pass through the respective shuttle valves 222, 224, 226 and on to the actuated respective clamping cylinder. In practice, the pressure differential across the inlet ports of this type of shuttle valve 222, 224, 226 must be a minimum of 10 psi for the shuttle 222, 224, 226 to initiate and complete the act of isolating the port offering the lower pressure from the active actuator circuit.

Under normal operation the system supplies regulated pressurized air to ports designated A, B and C. The air flows at A, B and C pressurize the respective sealing roll, lamella, and side plate clamping cylinder circuits. A reserve supply release solenoid valve 228 is held in an open position by energized solenoid to contain the pressurized volume of reserve air in the reserve supply storage tank 230 and its pneumatic circuit while allowing a no pressure condition at ports A', B' and C', opposite to pressures A, B and C at their respective shuttle valves 222, 224 and 226. Plant air also supplies pressure to a solenoid valve 234 that controls non-operational functions of refilling the storage tank (required following the release of the reserve air volume to the cylinders, and return of the system to a normal power and plant air pressure operating condition), and a reserve system evacuation solenoid valve 236 that evacuates of the storage tank 230 to de-energize the pneumatic system prior to the performance of maintenance at or in the vicinity of the sealing heads 20 and 30. As noted, these functions are controlled by a PLC.

The first mode of system failure is loss of electrical power to the system which causes the solenoid valves within the primary pneumatic control 240 to shift to a closed position, isolating the system from available plant air pressure. No air flow is permitted through the valve in this state, and with the presence of O-ring seals in the valves, and piston seals in the cylinders, the pressurized volume captured in the now-closed circuit will remain pressurized for a period of time, the length of which depends on the rate of depletion of the closed system volume, with which occurs a decrease in system pressure until the pressure lowers to a level which allows the steam pressure within the tunnel 10 to displace the pressurized cylinders, causing the clamped seals to open.

Upon a power failure, this solenoid valve 228 will shift to the closed position via spring return of the spool, releasing the reserve pressurized volume from the storage tank 230 to ports A', B' and C' of shuttle valves 222, 224 and 226. Pressure at these ports ensures that as the pressures A, B and C decrease, the reserve pressure is available to pressurize the cylinders once the 10 psi pressure differential is exceeded, where pressure A'>A, B'>B, C'>C.

In practice, the set pressure level in the reserve supply tank 230 should be set at a high enough level to shift the shuttle valves 222, 224 and 226 well before the clamping system can release due to decreased primary system pressures A, B and C.

The second mode of failure is the partial or complete loss of pressure in the plant air supply. In this instance, pressure at ports A through C will diminish or go to zero, and the reaction of the reserve supply circuit will be the same as described in the power loss failure example of the previous paragraph, as solenoid valve 228 will shift to the closed position in reaction to feedback to a PLC from a pressure switch to monitor for the presence of an adequate supply of air pressure. The reserve supply tank 230 air regulated pressure level is set high enough to quickly release the reserve supply air volume well before the clamped seals can release due to primary air supply pressure loss.

A heat setting machine and a sealing head for a heat setting machine are described above. Various details of the invention may be changed without departing from its scope. Furthermore, the foregoing description of the preferred embodiment of the invention and the best mode for practicing the invention are provided for the purpose of illustration only and not for the purpose of limitation—the invention being defined by the claims.

We claim:

1. A continuous process heat set tunnel for setting yarn, comprising:

(a) a heat set tunnel adapted to extend longitudinally along a supporting floor surface and including an entrance end and an entrance sealing roll assembly and an exit end and an exit sealing roll assembly;

(b) an interconnected entrance cooling section, yarn steaming chamber and exit cooling section positioned intermediate the entrance sealing roll assembly and the exit sealing roll assembly;

(c) an endless conveyor belt adapted to transport yarn into, through and out of the heat set tunnel;

(d) an entrance sealing head for sealing the entrance end of the heat set tunnel against loss of steam and pressure, and an exit sealing head for sealing the exit end of the heat set tunnel against loss of steam and pressure, the entrance sealing head and the exit head sealing head each comprising:

(1) a sealing roll frame for being mounted in heat-sealing relation adjacent the entrance end;

(2) a bottom sealing roll mounted for rotation in the sealing roll frame;

(3) a top sealing roll mounted for rotation in the sealing roll frame and above the bottom sealing roll in roll surface contact with the bottom sealing roll along respective laterally-extending roll widths and defining a nip between which a yarn-transporting conveyor is adapted to pass;

(4) the top sealing roll and the bottom sealing roll interconnected in a respective driving and driven configuration relative to each other;

(5) a prime mover assembly adapted to provide rotation to the driving one of the top sealing roll and the bottom sealing roll for passing the conveyor through the nip;

(6) a top lamella engaging the top sealing roll along its width to prevent escape of steam and pressure from the heat set tunnel past the top sealing roll and a bottom lamella engaging the bottom sealing roll along its width to prevent the escape of steam and pressure from the heat set tunnel past the bottom sealing roll;

(7) first and second laterally-spaced pneumatic sealing roll cylinders carried by the sealing roll frame for exerting a sealing force against the top sealing roll, the conveyor and the bottom sealing roll;

(8) at least first and second top pneumatic lamella sealing cylinders mounted on the sealing roll frame for exerting against the top lamella a sealing force against the roll surface of the top sealing roll;

(9) at least first and second bottom pneumatic lamella sealing cylinders mounted on the sealing roll frame for exerting against the bottom lamella a sealing force against the roll surface of the bottom sealing roll; and (e) a compressed air supply reservoir isolated from a primary compressed air supply in a normally closed pneumatic connection for maintaining pressure to the first and second laterally-spaced pneumatic sealing roll cylinders, the at least first and second top pneumatic lamella sealing cylinders and the at least first and second bottom pneumatic lamella sealing cylinders upon a loss of pneumatic air supply pressure, and including an electronically controlled pneumatic circuit that maintains the normally closed pneumatic connection between the air supply reservoir and the sealing roll cylinders during normal heat set tunnel operation;

(1) a plurality of independent pneumatic circuits supplying pressure to selected groups of first and second laterally-spaced pneumatic sealing roll cylinders, the at least first and second top pneumatic lamella sealing cylinders, the at least first and second bottom pneumatic lamella sealing cylinders and a plurality of side pneumatic cylinders exerting a sealing force in a direction perpendicular to the force applied by the first and second laterally-spaced pneumatic sealing roll cylinders carried by the sealing roll frame for exerting a sealing force against the top sealing roll upon a loss of electrical power or plant pneumatic pressure, whereby;

(2) upon an occurrence of a loss of electrical power, the reservoir pneumatic circuit is adapted to shift from a normally closed position to an open position to isolate the reservoir pneumatic circuit from a primary air pressure supply circuit and to release air from the compressed air supply reservoir to the sealing cylinders for exerting a continuing sealing force against the sealing surfaces of the sealing heads to retain steam and associated heat energy within the heat set tunnel; and (3) upon an occurrence of a loss of pneumatic pressure in the primary compressed air supply, the reservoir pneumatic circuit is adapted to shift from a normally closed position to an open position and to release air from the compressed air supply reservoir to the sealing cylinders for exerting a continuing sealing force against the surfaces of the sealing heads to contain steam and associated heat energy within the heat set tunnel.

2. A continuous process heat set tunnel according to claim 1, and including first, second and third top lamella sealing cylinders mounted on the sealing roll frame between the first and second laterally-spaced pneumatic sealing roll cylinders.

3. A continuous process heat set tunnel according to claim 1, and including first, second and third bottom lamella sealing cylinders mounted on a bottom frame of the sealing roll frame.

4. A continuous process heat set tunnel according to claim 1, and including first, second and third top lamella sealing cylinders mounted on the sealing roll frame between the first and second laterally-spaced pneumatic sealing roll cylinders and first, second and third bottom lamella sealing cylinders mounted on a bottom frame of the sealing roll frame.

5. A continuous process heat set tunnel according to claim 1, wherein the plurality of side pneumatic cylinders exert a sealing force in a direction perpendicular to the force applied by the first and second laterally-spaced pneumatic sealing roll cylinders carried by the sealing roll frame for exerting a sealing force against the top sealing roll.

6. A sealing head for sealing an end opening of a heat set tunnel against loss of steam and pressure, comprising:

(a) a sealing roll frame for being mounted in heat-sealing relation adjacent the end opening;

(b) a bottom sealing roll mounted for rotation in the sealing roll frame;

(c) a top sealing roll mounted for rotation in the sealing roll frame and above the bottom sealing roll in roll surface contact with the bottom sealing roll along respective laterally-extending roll widths and defining a nip between which a yarn-transporting conveyor is adapted to pass;

(d) the top sealing roll and the bottom sealing roll interconnected in a respective driving and driven configuration relative to each other;

(e) a prime mover assembly adapted to provide rotation to the driving one of the top sealing roll and the bottom sealing roll for passing the conveyor through the nip;

(f) a top lamella engaging the top sealing roll along its width to prevent escape of steam and pressure from the heat set tunnel past the top sealing roll and a bottom lamella engaging the bottom sealing roll along its width to prevent the escape of steam and pressure from the heat set tunnel past the bottom sealing roll;

(g) first and second laterally-spaced pneumatic sealing roll cylinders carried by the sealing roll frame for exerting a sealing force against the top sealing roll, the conveyor and the bottom sealing roll;

(h) at least first and second top pneumatic lamella sealing cylinders mounted on the sealing roll frame for exerting against the top lamella a sealing force against the roll surface of the top sealing roll;

(i) at least first and second bottom pneumatic lamella sealing cylinders mounted on the sealing roll frame for exerting against the bottom lamella a sealing force against the roll surface of the bottom sealing roll, and;

(j) a compressed air supply reservoir isolated from a primary compressed air supply in a normally closed pneumatic connection for maintaining pressure to the first and second laterally-spaced pneumatic sealing roll cylinders, the at least first and second top pneumatic lamella sealing cylinders and the at least first and second bottom pneumatic lamella sealing cylinders upon a loss of pneumatic air supply pressure, and including an electronically controlled pneumatic circuit that maintains the normally closed pneumatic connection between the air supply reservoir and the sealing roll cylinders during normal heat set tunnel operation;

(1) a plurality of independent pneumatic circuits supplying pressure to selected groups of first and second laterally-spaced pneumatic sealing roll cylinders, the at least first and second top pneumatic lamella sealing cylinders, the at least first and second bottom pneumatic lamella sealing cylinders and a plurality of side pneumatic cylinders exerting a sealing force in a direction perpendicular to the force applied by the first and second laterally-spaced pneumatic sealing roll cylinders carried by the sealing roll frame for exerting a sealing force against the top sealing roll upon a loss of electrical power or plant pneumatic pressure, whereby;

(2) upon an occurrence of a loss of electrical power, the reservoir pneumatic circuit is adapted to shift from a normally closed position to an open position to isolate the reservoir pneumatic circuit from a primary air pressure supply circuit and to release air from the compressed air supply reservoir to the sealing cylinders for exerting a continuing sealing force against the sealing surfaces of the sealing heads to retain steam and associated heat energy within the heat set tunnel; and (3) upon an occurrence of a loss of pneumatic pressure in the primary compressed air supply, the reservoir pneumatic circuit is adapted to shift from a normally closed position to an open position and to release air from the compressed air supply reservoir to the sealing cylinders for exerting a continuing sealing force against the surfaces of the sealing heads to contain steam and associated heat energy within the heat set tunnel.

7. A sealing head according to claim 6, wherein the bottom sealing roll is mounted for rotation about a fixed position axis of rotation and the top sealing roll is mounted for rotation about a variable position axis of rotation relative to the bottom sealing roll.

8. A sealing head according to claim 6, and including first and second gibs mounted on the sealing roll frame in radial alignment with respective first and second laterally spaced-apart bearing blocks in which the top and bottom sealing rolls are mounted for rotation, each of the first and second gibs adapted to engage the spaced-apart bearing blocks for allowing vertical motion of the top and bottom sealing rolls relative to each other while restricting longitudinal, axial, or rotational movement of the bearing blocks.

9. A sealing head according to claim 8, wherein the first and second gibs each comprise at least two vertically-spaced floating gib segments adapted to move independently of each other in response to vertical movement of the top sealing roll relative to the bottom sealing roll.

10. A sealing head according to claim 8, wherein the first and second gibs are each affixed to a stationary base by at least one spring element that passively applies a uniform and repeatable contact force within a range upon a slidable connection to a bearing block through which the top and bottom sealing rolls rotate, the slidable connection and contact force restricting longitudinal, axial or rotational movement of the bearing block while permitting controlled vertical movement of the bearing block.

11. A sealing head according to claim 6, wherein the first and second laterally-spaced pneumatic sealing roll cylinders are adapted to lift the top sealing roll vertically out of sealing contact with the bottom sealing roll.

12. A sealing head according to claim 6, and including first, second and third bottom lamella sealing cylinders mounted on a bottom frame of the sealing roll frame.

13. A sealing head according to claim 6, and including first, second and third top lamella sealing cylinders mounted on the sealing roll frame between the first and second laterally-spaced pneumatic sealing roll cylinders and first, second and third bottom lamella sealing cylinders mounted on a bottom frame of the sealing roll frame.

14. A sealing head according to claim 6, and including a plurality of side pneumatic cylinders mounted on the sealing roll frame for exerting a sealing force against opposing ends of the top sealing roll and the bottom sealing roll.

15. A sealing head according to claim 14, wherein the plurality of side pneumatic cylinders exert a sealing force in a direction perpendicular to the force applied by the first and second laterally-spaced pneumatic sealing roll cylinders carried by the sealing roll frame for exerting a sealing force against the top sealing roll.

16. A sealing head for sealing an end opening of a heat set tunnel against loss of steam and pressure, comprising:

(a) a sealing roll frame for being mounted in heat-sealing relation adjacent the end opening;

(b) a bottom sealing roll mounted for rotation in the sealing roll frame;

(c) a top sealing roll mounted for rotation in the sealing roll frame and above the bottom sealing roll in roll surface contact with the bottom sealing roll along respective laterally-extending roll widths and defining a nip between which a yarn-transporting conveyor is adapted to pass;

(d) the top sealing roll and the bottom sealing roll interconnected in a respective driving and driven configuration relative to each other;

(e) a motor and a connected gear train for driving one of the top sealing roll and the bottom sealing roll and for passing the conveyor through the nip;

(f) a top lamella engaging the top sealing roll along its width to prevent escape of steam and pressure from the heat set tunnel past the top sealing roll and a bottom lamella engaging the bottom sealing roll along its width to prevent the escape of steam and pressure from the heat set tunnel past the bottom sealing roll;

(g) first and second laterally-spaced pneumatic sealing roll cylinders carried by the sealing roll frame for exerting a sealing force against the top sealing roll, the conveyor and the bottom sealing roll;

(h) three pneumatic lamella sealing cylinders mounted on the sealing roll frame between and in lateral alignment with the first and second laterally-spaced pneumatic sealing roll cylinders for exerting against the top lamella a sealing force against the roll surface of the top sealing roll;

(i) three pneumatic lamella sealing cylinders mounted on the sealing roll frame for exerting against the bottom lamella a sealing force against the roll surface of the bottom sealing roll;

(j) four side pneumatic cylinders mounted on the sealing roll frame for exerting a sealing force against opposing ends of the top sealing roll and the bottom sealing roll in a direction perpendicular to the force applied by the first and second laterally-spaced pneumatic sealing roll cylinders; and (k) a compressed air supply reservoir pneumatic circuit isolated from a primary compressed air supply in a normally closed pneumatic connection for maintaining pressure to the first and second laterally-spaced pneumatic sealing roll cylinders, the at least first and second top pneumatic lamella sealing cylinders and the at least first and second bottom pneumatic lamella sealing cylinders upon a loss of pneumatic air supply pressure, and including an electronically controlled pneumatic circuit that maintains the normally closed pneumatic connection between the air supply reservoir and the sealing roll cylinders during normal heat set tunnel operation;

(1) a plurality of independent pneumatic circuits supplying pressure to selected groups of first and second laterally-spaced pneumatic sealing roll cylinders, the at least first and second top pneumatic lamella sealing cylinders, the at least first and second bottom pneumatic lamella sealing cylinders and a plurality of side pneumatic cylinders exerting a sealing force in a direction perpendicular to the force applied by the first and second laterally-spaced pneumatic sealing roll cylinders carried by the sealing roll frame for exerting a sealing force against the top sealing roll upon a loss of electrical power or plant pneumatic pressure, whereby;

(2) upon an occurrence of a loss of electrical power, the reservoir pneumatic circuit is adapted to shift from a normally closed position to an open position to isolate the reservoir pneumatic circuit from a primary air pressure supply circuit and to release air from the compressed air supply reservoir to the sealing cylinders for exerting a continuing sealing force against the sealing surfaces of the sealing heads to retain steam and associated heat energy within the heat set tunnel; and (3) upon an occurrence of a loss of pneumatic pressure in the primary compressed air supply, the reservoir pneumatic circuit is adapted to shift from a normally closed position to an open position and to release air from the compressed air supply reservoir to the sealing cylinders for exerting a continuing sealing force against the surfaces of the sealing heads to contain steam and associated heat energy within the heat set tunnel.

17. A sealing head for sealing an end opening of a heat set tunnel against loss of steam and pressure, comprising:

(a) a sealing roll frame for being mounted in heat-sealing relation adjacent the end opening;

(b) a bottom sealing roll mounted for rotation in the sealing roll frame;

(c) a top sealing roll mounted for rotation in the sealing roll frame and above the bottom sealing roll in roll surface contact with the bottom sealing roll along respective laterally-extending roll widths and defining a nip between which a yarn-transporting conveyor is adapted to pass;

(d) the top sealing roll and the bottom sealing roll interconnected in a respective driving and driven configuration relative to each other;

(e) a prime mover assembly adapted to provide rotation to the driving one of the top sealing roll and the bottom sealing roll for passing the conveyor through the nip;

(f) a top lamella engaging the top sealing roll along its width to prevent escape of steam and pressure from the heat set tunnel past the top sealing roll and a bottom lamella engaging the bottom sealing roll along its width to prevent the escape of steam and pressure from the heat set tunnel past the bottom sealing roll;

(g) first and second laterally-spaced pneumatic sealing roll cylinders carried by the sealing roll frame for exerting a sealing force against the top sealing roll, the conveyor and the bottom sealing roll;

(h) at least first and second top pneumatic lamella sealing cylinders mounted on the sealing roll frame for exerting against the top lamella a sealing force against the roll surface of the top sealing roll;

(i) at least first and second bottom pneumatic lamella sealing cylinders mounted on the sealing roll frame for exerting against the bottom lamella a sealing force against the roll surface of the bottom sealing roll;

(j) first and second gibs mounted on the sealing roll frame in radial alignment with respective first and second laterally spaced-apart bearing blocks in which the top and bottom sealing rolls are mounted for rotation, each of the first and second gibs adapted to engage the spaced-apart bearing blocks for allowing vertical motion of the top and bottom sealing rolls relative to each other while restricting longitudinal, axial, or rotational movement of the bearing blocks, wherein the first and second gibs each comprise at least two vertically-spaced floating gib segments adapted to move independently of each other in response to vertical movement of the top sealing roll relative to the bottom sealing roll.

18. A sealing head according to claim 17, wherein the first and second gibs are each affixed to a stationary base by at least one spring element that passively applies a uniform and repeatable contact force within a range upon a slidable connection to a bearing block through which the top and bottom sealing rolls rotate, the slidable connection and contact force restricting longitudinal, axial or rotational movement of the bearing block while permitting controlled vertical movement of the bearing block.

* * * * *